US005502434A

United States Patent [19]

Minowa et al.

[11] Patent Number: 5,502,434

[45] Date of Patent: Mar. 26, 1996

[54] SMOKE SENSOR

[75] Inventors: Osami Minowa, Machida; Junichi Narumiya, Fujisawa; Tetsuya Nagashima, Sagamihara; Yoshihito Hirai, Odawara; Mariko Ishida, Yokohama, all of Japan

[73] Assignee: Hockiki Kabushiki Kaisha, Tokyo, Japan

[21] Appl. No.: 66,909

[22] Filed: May 21, 1993

[30] Foreign Application Priority Data

| | | | |
|---|---|---|---|
| May 29, 1992 | [JP] | Japan | 4-161726 |
| May 29, 1992 | [JP] | Japan | 4-161727 |
| May 29, 1992 | [JP] | Japan | 4-161728 |
| May 29, 1992 | [JP] | Japan | 4-161729 |
| Jun. 8, 1992 | [JP] | Japan | 4-173758 |

[51] Int. Cl.[6] ..... G08B 17/10

[52] U.S. Cl. ..... 340/630; 340/628; 250/574; 356/439

[58] Field of Search ..... 340/628, 630, 340/632; 250/573, 574; 356/436, 438, 439, 341

[56] References Cited

U.S. PATENT DOCUMENTS

| | | | |
|---|---|---|---|
| 4,559,453 | 12/1985 | Muggli et al. | 340/630 |
| 4,568,926 | 2/1986 | Malinowski | 340/630 |
| 4,647,785 | 3/1987 | Morita | 340/630 |
| 4,757,306 | 7/1988 | Kimura | 340/630 |
| 4,866,425 | 9/1989 | Lindmark | 340/630 |
| 5,247,283 | 9/1993 | Kobayashi et al. | 340/630 |
| 5,280,272 | 1/1994 | Nagashima et al. | 340/630 |

*Primary Examiner*—John K. Peng
*Assistant Examiner*—Edward Lefkowitz
*Attorney, Agent, or Firm*—Lackenbach Siegel Marzullo Aronson & Greenspan

[57] ABSTRACT

A separate type photoelectric smoke sensor having a light emitting section for emitting a light beam to a reflecting plate disposed at a certain distance from the light emitting section, a light receiving section for receiving reflected light from the reflecting plate, and a judgement section for outputting a sense signal if a received light output from the light receiving section is smaller than a threshold value previously set. The quantity of reflected light from a shielding object is obtained from the difference between or the ratio of the quantity of received light measured during lighting of the light emitting section in a situation where there is no shielding object and the quantity of received light measured during lighting of the light emitting section in a situation where there is the shielding object, and the difference between these quantities of reflected light and the quantity of received light measured during lighting of the light emitting section is compared with the threshold value to determine whether or not there is a fire. It is thereby possible to correctly discriminate the existence of any shielding object other than smoke in an observed region. Even if there is a shielding object, the influence of the shielding object is cancelled to obtain the true quantity of reflected light from the reflecting plate no matter what the reflectivity thereof, thereby ensuring accurate determination as to whether or not there is a fire.

17 Claims, 22 Drawing Sheets

| OBSERVATION DISTANCE(m) | 20 | 40 | 50 | 75 | 100 |
|---|---|---|---|---|---|
| RECEIVED LIGHT QUANTITY RATIO FIRE OBSERVATION : SHIELD OBSERVATION | 25:1 | 15:1 | 10:1 | 7:1 | 5:1 |

FIG.15(a)

QUANTITY OF REFLECTED LIGHT FROM RETROREFLECTION MIRROR

| WHEN FIRE-OBSERVATION LIGHT RECEIVING DEVICE 653 RECEIVES LIGHT | WHEN SHIELD-OBSERVATION LIGHT RECEIVING DEVICE 654 RECEIVES LIGHT |
|---|---|
| (REFLECTED LIGHT: DIRECTION A DIRECTION A OF RECEIVING-SIDE FILTER) | (REFLECTED LIGHT: DIRECTION A DIRECTION B OF RECEIVING-SIDE FILTER) |

FIG.15(b)

QUANTITY OF REFLECTED LIGHT FROM RETROREFLECTION MIRROR

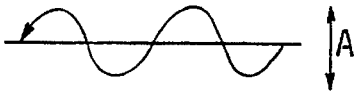

QUANTITY OF REFLECTED LIHGT FROM OBJECT

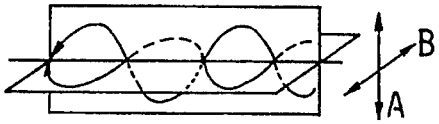

WHEN FIRE-OBSERVATION LIGHT RECEIVING DEVICE 653 RECEIVES LIGHT (REFLECTED LIGHT: DIRECTION A + NON-POLARIZED LIGHT DIRECTION A OF RECEIVING-SIDE FILTER)

QUANTITY OF REFLECTED LIHGT FROM OBJECT

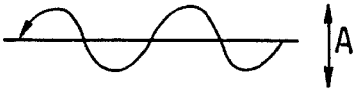

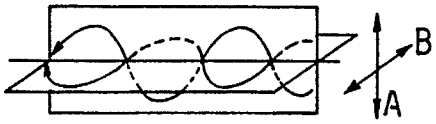

WHEN SHIELD-OBSERVATION LIGHT RECEIVING DEVICE 654 RECEIVES LIGHT (REFLECTED LIGHT: DIRECTION A + NON-POLARIZED LIGHT DIRECTION B OF RECEIVING-SIDE FILTER)

SMOKE SENSOR

BACKGROUND OF THE INVENTION

1. Field of the Invention

This invention relates to a separate type smoke sensor which emits lights to a reflecting plate disposed at a certain distance from the sensor, receives reflected light from the reflecting plate and outputs a sense signal if the level of received light is reduced to a predetermined threshold value by smoke entering an observed region. More particularly, this invention relates to a separate type smoke sensor which can cancel the influence of a shielding object to obtain the true quantity of reflected light from a reflecting plate no matter what the reflectivity of the shielding object, and which, therefore, can correctly determine whether or not there is a fire.

2. Description of the Related Art

A sensor arranged as Japanese Patent Provisional Publication No. 296641/92 (Japanese Patent Application No. 146460/91) is known as a conventional photoelectric smoke sensor of this kind.

A reflecting plate is placed across an optical axis of light emitted from a light emitting portion. Light reflected by the reflecting plate is received by a light receiving portion. If the light is intercepted by intrusion of smoke, a received light level at the light receiving portion is changed. This change is detected and the received light level and a predetermined threshold value are compared to determine whether or not there is a fire.

FIG. 26(*a*) schematically shows the construction of a conventional separate type photoelectric smoke sensor. As can be understood from FIG. 26(*a*), in the conventional separate type photoelectric smoke sensor, light from a light emitting device 102 provided in a sensor main unit 100 is collimated into a projected beam 106 by a lens 104, the beam 106 passes across an observation space, and the direction of traveling of the beam 106 is turned by 180° by a retroreflection mirror (reflecting plate) 101. A turned beam 107 is condensed by a light receiving lens 105 and received by a light receiving device 103. If smoke 110 generated by a fire exists in the observation space, the quantity of light of the received beam is reduced. A corresponding received light level is compared with a threshold value to recognize the fire. For example, if the level of a received light signal, which is normally 100 mW, is reduced to 50 mW, a fire signal is generated.

If, as shown in FIG. 26(*b*), a shielding object 121 other than smoke enters the observed region of the thus-constructed fire sensor under ordinary observation conditions, the sensor may erroneously determine that there is a fire by detecting a reduction in the level of a received light output from the light receiving portion. In such a situation, a person in charge goes to the place there the fire sensor is set, confirms the existence of the shielding and removes the shielding object to restore the ordinary observation conditions.

There is also a possibility of occurrence of a non-observing condition if the observation light is intercepted by a shielding object. A sensor capable of outputting a warning signal when the level of the received light signal becomes extremely low has also been proposed to avoid such a situation.

In the above-described separate type photoelectric smoke sensor, the received light level at the light receiving portion is reduced in the case of shielding of shielding object 121 having a low reflectivity. In such a case, a trouble detection operation may be performed to enable the above-described method to be used as an immediate means. However, if the shielding object has a high reflectivity, light from the light emitting portion is reflected by the shielding object 120 and received by the light receiving portion. In such a case, the same received light level as that under the normal condition can be obtained and there is a risk that the sensor may determine that the state of the observed area is normal even if there is a fire. A region between the shielding object 120 and the reflecting plate 101 cannot be observed and there is a risk of warning failure.

In some or many cases, this kind of sensor is placed close to a ceiling of a building. However, pipings and ducts are usually laid in the vicinity of building ceilings. If a place in which a separate type photoelectric smoke sensor is set is such that a pipe or a duct is within a limit radial range of the sensor, this type of sensor must be replaced with a different type of sensor in order to avoid warning failure due to reflection light from such a shielding object, even if it is effective to use the separate type photoelectric smoke sensor in other respects.

SUMMARY OF THE INVENTION

In view of the above-described problem, an object of the present invention is to provide a separate type photoelectric smoke sensor capable of correctly discriminating a shielding object other than smoke existing in an observed region, and capable of obtaining the true quantity of reflected light from a reflecting plate and correctly determining whether or not there is a fire by cancelling the influence of a shielding object no matter what the reflectivity of the shielding object.

To achieve this object, according to one aspect of the present invention, there is provided a separate type photoelectric smoke sensor comprising a light emitting section for emitting a light beam to a reflecting plate disposed at a certain distance from the light emitting section, a light receiving section for receiving reflected light from the reflecting plate, and a judgement section for outputting a sense signal if a received light output from the light receiving section is smaller than a threshold value previously set, wherein the quantity of reflected light from a shielding object is obtained from the difference between or the ratio of the quantity of received light measured during lighting of the light emitting section in a situation where there is no shielding object and the quantity of received light measured during lighting of the light emitting section in a situation where there is the shielding object, and the difference between these quantities of reflected light and the quantity of received light measured during lighting of the light emitting section is compared with the threshold value to determine whether or not there is a fire. The influence of the shielding object can be cancelled by obtaining the quantity of reflected light from the shielding object, thereby enabling true quantity of reflected light from the reflecting plate to be obtained. It is therefore possible to accurately determine whether or not there is a fire, even if there is any shielding object in the observed region.

Preferably, according to another aspect of the invention, a fire-observation light emitting section and a shield-observation light emitting section may be provided. The shield-observation light emitting section is provided in a position deviated from an optical axis connecting the fire-observation light emitting section, the reflecting plate and the light receiving section and at a certain distance from the fire observation light emitting section. The fire-observation light emitting section and the shield-observation light emitting section are alternately lighted intermittently. The quantity of reflected light from a shielding object is obtained from the quantity of received light measured during lighting of the fire-observation light emitting section, the quantity of received light measured during lighting of the shield-observation light emitting section and the ratio of the quantity of received light measured during lighting of the fire-observation light emitting section in a situation where there is no shielding object and the quantity of received light measured during lighting of the shield-observation light emitting section in the same situation. The difference between the quantity of reflected light thereby obtained and the quantity of received light measured during lighting of the fire-observation light emitting section is compared with the threshold value to determine whether or not there is a fire.

Thus, the fire-observation light emitting section is disposed close to the light receiving portion while the shield-observation light emitting section is disposed remote from the light receiving section, these light emitting sections are alternately lighted intermittently, and predetermined calculations are performed on the basis of the quantities of received light during periods of lighting of these light emitting sections to obtain the quantity of reflected light from a shielding object. It is thereby possible to cancel the influence of the shielding object upon the quantity of received light.

According to yet another aspect of the invention, a fire-observation light receiving section and a shield-observation light receiving section may be provided. The shield-observation light receiving section is provided in a position deviated from an optical axis connecting the light emitting section, the reflecting plate and the fire-observation light receiving section and at a predetermined distance from the fire-observation light receiving section. The light emitting section is lighted intermittently. Light emitted from the light emitting section is alternately received by the fire-observation light receiving section and the shield-observation light receiving section. The quantity of reflected light from a shielding object is obtained from the quantity of received light measured during light receiving with the fire-observation light receiving section, the quantity of received light measured during light-receiving with the shield-observation light receiving section and the ratio of the quantity of received light measured during light-receiving with the fire-observation light receiving section in a situation where there is no shielding object and the quantity of received light measured during light-receiving with the shield-observation light receiving section in the same situation. The difference between the quantity of reflected light thereby obtained and the quantity of received light measured during light-receiving with the fire-observation light receiving section is compared with the threshold value to determine whether or not there is a fire. Also by this arrangement, it is possible to accurately determine whether or not there is a fire, as in the case of the above-described arrangement, even if there is any shielding object in the observed region.

According to still another aspect of the invention, the light emitting section may be formed of a fire-observation light emitting section for emitting a light beam of a predetermined first wavelength, and a shield-observation light emitting section for emitting a light beam of a predetermined second wavelength, and a filter for transmitting only light of the first wavelength may be disposed in front of the reflecting plate. The fire-observation light emitting section and the shield-observation light emitting section are alternately lighted intermittently. The quantity of received light measured during lighting of the fire-observation light emitting section and the quantity of received light measured during lighting of the shield-observation light emitting section are compared and the difference between these quantities of received light and the threshold value are compared to determine whether or not there is a fire.

Thus, the two-light emitting sections for fire-observation and shield-observation, differing in wavelength from each other, are provided in a sensor main unit, a filter for transmitting only light of a particular wavelength, i.e., only the from the fire-observation light emitting portion is disposed in front of the reflecting plate, these light emitting sections are alternately lighted intermittently, and predetermined calculations are performed on the basis of the quantities of received light during periods of lighting of these light emitting sections to obtain the quantity of reflected light from a shielding object. It is thereby possible to cancel the influence of the shielding object upon the quantity of received light. Also in this case, a determination as to the existence of a fire may be made by comparing present data and immediately preceding data, whereby, even if other shielding objects enter the observed region of even if the quantity of reflected light from the shielding object is changed or the quantity of received light is reduced, for example, by a contamination of the lens, the influence of such a change can be canceled. Accordingly, it is possible to accurately determine whether or not there is a fire.

According to a further aspect of the invention, the light receiving section may be formed of a fire-observation light receiving section having a filter for transmitting only a light beam of a predetermined first wavelength, and a shield-observation light receiving section having a filter for transmitting only a light beam of a predetermined second wavelength, and a filter for transmitting only light of the first wavelength may be disposed in front of the reflecting plate. The light emitting section is arranged to emit light having both the first and second wavelengths. The quantities of light received by the fire-observation light receiving section and the shield-observation light receiving section are compared and the difference between the quantities of received light and the threshold value are compared.

According to still a further aspect of the invention, the arrangement may also be such that a first polarization filter is disposed in front of the reflecting plate, and a second polarization filter having the same plane of polarization as the first polarization filter is disposed in front of the fire-observation light emitting section, and a third polarization filter having a plane of polarization shifted by 90° from a plane of polarization of the first polarization filter is disposed in front of the shield-observation light emitting section. The fire-observation light emitting section and the shield-observation light emitting section are alternately lighted intermittently. The quantity of received light measured during lighting of the fire-observation light emitting section and the quantity of received light measured during lighting of the shield-observation light emitting section are compared and the difference between the quantities of received light and the threshold value are compared to determine whether or not there is a fire.

Thus, two light emitting sections for fire observation and shield observation are provided, polarization filters having different planes of polarization are respectively provided on these light emitting sections, and a polarization filter having the same plane of polarization as the polarization filter on the fire-observation light emitting section is disposed in front of the reflecting plate. These light emitting sections are alternately lighted intermittently, predetermined calculations are performed on the basis of the quantities of received light obtained during this lighting to obtain the quantity of reflected light from a shielding object. It is thereby possible to cancel the influence of the shielding object upon the quantity of received light. Therefore, even if other shielding objects enter the observed region of even if the quantity of reflected light from the shielding object is changed or the quantity of received light is reduced, for example, by a contamination of the lens, the influence of such a change can be canceled.

According to still a further aspect of the invention, the arrangement may be such that a first polarization filter is disposed in front of the reflecting plate, a second polarization filter having the same plane of polarization as the first polarization filter is disposed in front of the fire-observation light receiving section, and a third polarization filter having a plane of polarization shifted by 90° from a plane of polarization of the first polarization filter is disposed in front of the shield-observation light receiving section. The light emitting section is lighted intermittently, light emitted from the light emitting section is alternately received by the fire-observation light receiving section and the shield-observation light receiving section, the quantity of reflected light measured during light receiving with the fire-observation light receiving section and the quantity of received light measured during light-receiving with the shield-observation light receiving section are compared and the difference between the quantities of reflected light and the threshold value are compared.

According to still a further aspect of the invention, the arrangement may be such that a first polarization filter is disposed in front of the reflecting plate, and a second polarization filter is rotatably disposed in front of one of the light receiving section and the light emitting section. The light emitting section is lighted intermittently. The second polarization filter is rotated in synchronization with cycles of the lighting by 90° at one time so that the planes of polarization of the first and second polarization filters coincide with each other or are shifted from each other by 90°. The quantity of received light measured when the planes of polarization of the first and second polarization filters coincide with each other and the quantity of received light measured when the planes of polarization of the first and second polarization filters are shifted by 90° from each other are compared and the difference between the quantities of received light and the threshold value are compared. The second polarization filter may be rotated by a motor.

Thus, a rotatably polarization filter is provided on one of the light emitting section and the light receiving section, and light is emitted while the polarization filter is alternately stopped at a position at which the plane of polarization thereof coincides with that of the polarization filter in front of the reflecting plate, and a position at which the plane of polarization thereof is shifted by 90° form that of the polarization filter in front of the reflecting plate. Thus, while one light emitting device and one light receiving device, such as those used in the conventional arrangement, are used, the influence of any shielding object can be canceled and the true quantity of reflected light can be obtained. It is therefore possible to eliminate the influence of any shielding object by a simple method, and to achieve the effect of the present invention only by modifying the conventional arrangement. If the polarization filter is rotated with a motor, the angle control accuracy can be improved.

According to still a further aspect of the invention, the arrangement may be such that shading means having a low reflectivity is provided in front of the reflecting plate to intercept, for a predetermined period of time, light which travels from the light emitting section to be incident upon the reflecting plate, the quantity of received light measured during shading of the reflecting plate and the quantity of received light measured during exposure of the reflecting plate are compared, and the difference between the quantities of received light and the threshold value are compared.

Thus, low-reflectivity shading means is provided in front of the reflecting plate and are periodically operated to periodically change the quantity of light received from the reflecting plate. The difference between the quantity of received light measured during shading of the reflecting plate and the quantity of received light measured during exposure of the reflecting plate received light is thereby obtained to cancel the influence of any shielding object upon the quantity of received light.

In this case, the shading means may be a chopper having a low-reflectivity rotating blade rotated to mask a front surface of the reflecting plate for the predetermined period of time, or an electronic shutter changed between a transparent state and a shading state to mask a front surface of the reflecting plate for the predetermined period of time. Thus, the above-described effect can be achieved by a simple arrangement.

According to still a further aspect of the invention, the arrangement may be such that emission means for emitting a light beam in a predetermined first wavelength band is provided in the light emitting section, wavelength conversion means for converting the light beam in the first wavelength band into a light beam in a second wavelength band and outputting the converted light is provided in a reflecting section, and reception means for receiving reflected light from the reflecting section and a filter which transmits the light beam in the second wavelength band but which does not transmits the light beam in the first wavelength band are provided in the light receiving section.

Thus, a light emitting device for emitting a light in a predetermined first wavelength band, a light receiving device for receiving reflected light from the reflecting section, and a filter which transmits light in a second wavelength band but which does not transmits light in the first wavelength band are provided in the sensor main unit, and wavelength converting device for converting the light beam in the first wavelength band into a light beam in a second wavelength band and outputting the converted light is provided in the reflecting section, thereby canceling the influence of any shielding object upon the quantity of received light.

According to still a further aspect of the invention, the arrangement may be such that a first polarization filter is disposed in front of the light emitting section, a $\lambda/2$ wavelength plate is disposed in front of the reflecting plate to convert reflected light form the reflecting plate into a light beam having a phase different from a phase of the light beam passing through the first polarization filter, and a second polarization filter is disposed in front of the light receiving portion, the second polarization filter being in phase with reflected light passing through the $\lambda/2$ wavelength plate.

In this case, the arrangement may alternatively be such that a first polarization filter is disposed in front of the light emitting section, a second polarization filter is disposed in front of the light receiving portion, the second polarization filter having a plane of polarization shifted by 90° from a polarization plane of the first polarization filter, and a $\lambda/4$ wavelength plate is disposed in front of the reflecting plate.

BRIEF DESCRIPTION OF THE DRAWINGS

FIGS. 15(*a*) and 15(*b*) are diagrams of the quantity of received light in the sensor shown in FIG. 14;

DESCRIPTION OF THE PREFERRED EMBODIMENTS

Figure 1:
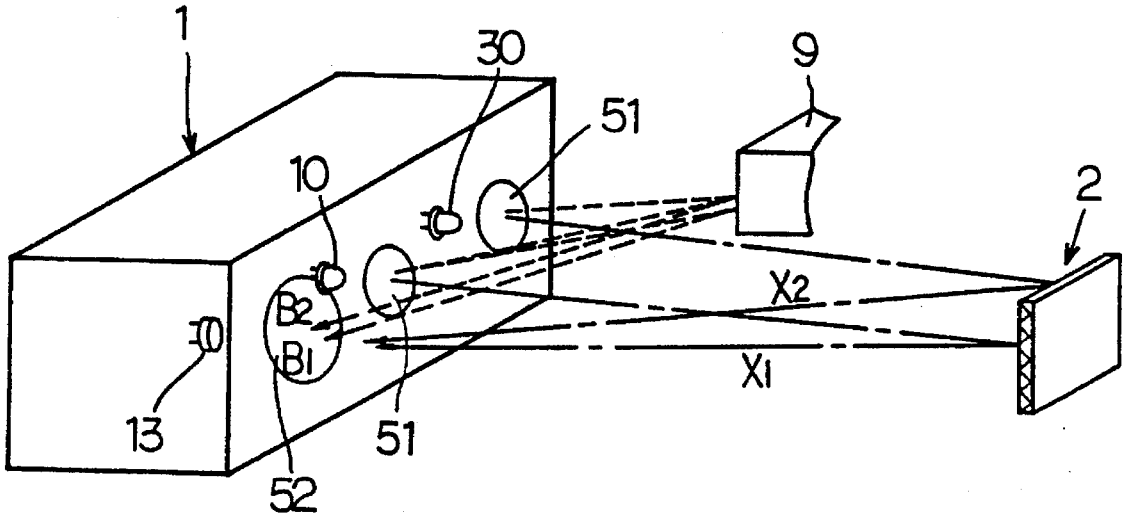
FIG. 1 is a perspective view of the overall construction of a separate type photoelectric smoke sensor in accordance with a first embodiment of the present invention.

Embodiments of the present invention will be described below with reference to the accompanying drawings. FIG. 1 is a perspective view of the overall construction of a separate type photoelectric smoke sensor in accordance with a first embodiment of the present invention. As illustrated, this separate type photoelectric smoke sensor emits a light beam from a main unit 1 to a reflecting plate 2 disposed at a certain distance from the main unit 1, and receives reflected light from the reflecting plate 2. The sensor outputs a fire sensing signal if the level of a received light output is lower than a threshold value previously set.

In the first and second embodiments, a characteristic of a retroreflection mirror provided as the reflecting plate 2 is utilized. In the first embodiment, two light emitting portions are disposed at a predetermined distance from each other, and the difference between the directions of reflection of two light beams from the light emitting portions based on the difference between the incident angles of the beams upon the reflecting plate 2 is utilized. That is, the true quantity of reflected light from the reflecting plate 2 is calculated from the difference between the quantities of light received by a light receiving portion resulting from the difference between the directions of reflection. The influence of a shielding object is thereby eliminated.

Figure 2:
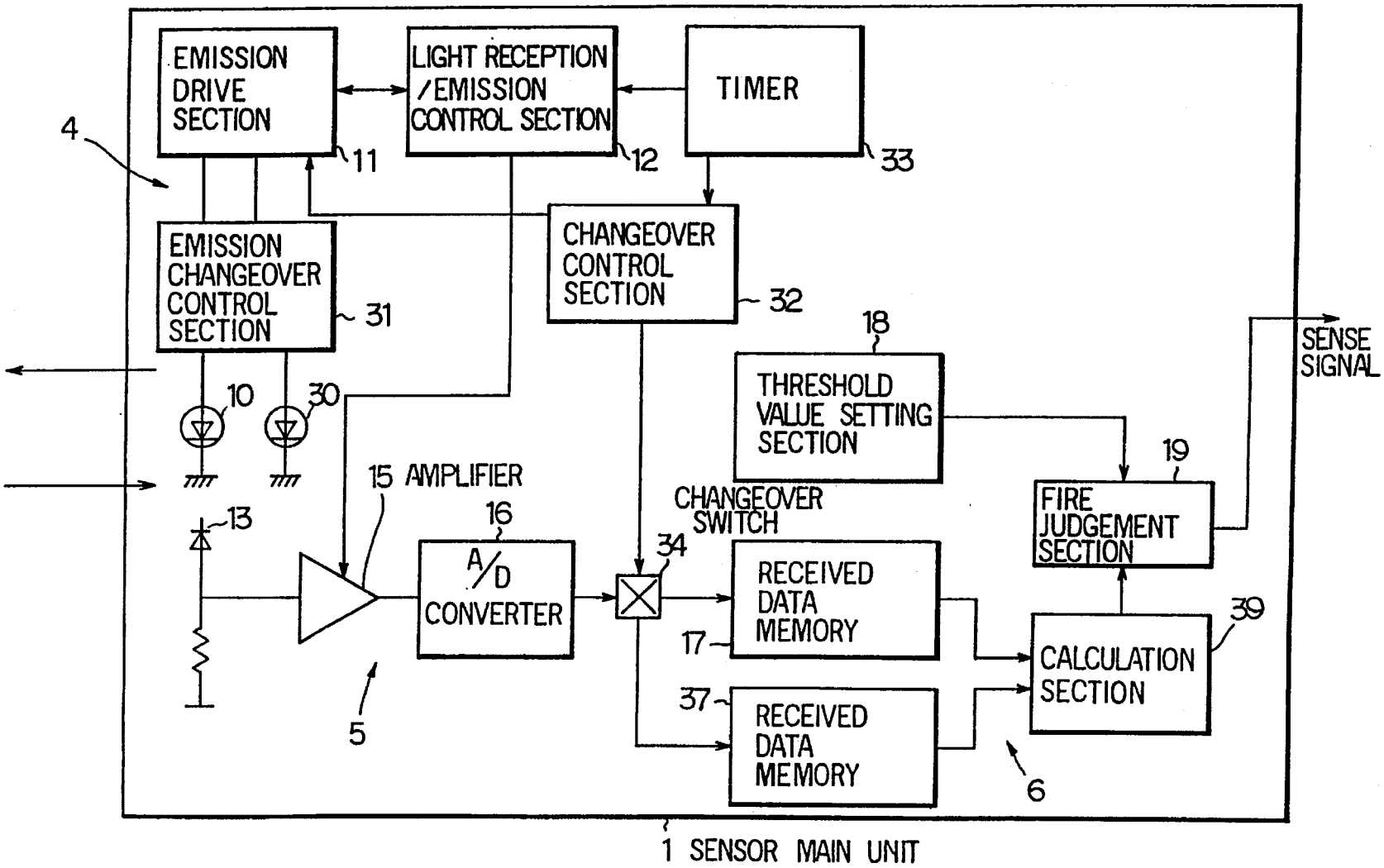
FIG. 2 is block diagram of the construction of a main unit of the sensor shown in FIG. 1.

First, the construction of the main unit 1 of the sensor will be described. FIG. 2 is a block diagram of the construction of the main unit 1 of the sensor.

The main unit 1 is generally sectioned into a light emitting section 4, a light receiving section 5 and a judgement section 6.

The light emitting section 4 has a fire-observation light emitting device 10 and a shield-observation light emitting device 30 which are light emitting diodes or the like for emitting near infrared light. The light emitting section 4 includes an emission changeover control section 31 for changing the emission of light between the fire-observation light emitting device 10 and the shield-observation light emitting device 30, and a changeover control section 32 for controlling the changeover therebetween. The light emitting section 4 further includes an emission drive section 11 for driving the fire-observation light emitting device 10 and the shield-observation light emitting device 30 through the emission changeover control section 31, a light reception/emission control section 12 for controlling the light emitting operation and the light receiving operation, and a timer 33 for setting changing times or periods of emission from the fire-observation light emitting device 10 and the shield-observation light emitting device 30. The fire-observation light emitting device 10 and the shield-observation light emitting device 30 are disposed on a plane at the same distance from the reflecting plate 2 and at a predetermined distance (e.g., 300 mm) from each other.

The light receiving section 5 has a light receiving device 13 for receiving light reflected by the reflecting plate 2. The light receiving section 5 includes an amplifier circuit 15 for amplifying an output from the light receiving device 13, and an A/D converter 16 for converting an analog signal from the amplifier circuit 15 into a digital signal representing received light data. The light receiving device 13 is disposed in the vicinity of the fire-observation light emitting device 10 (for example, at a distance of 20 mm from the light emitting device 10) and remote from the shield-observation light emitting device 30.

The judgement section 6 includes a changeover switch 34 for changing the place where the data outputted from the light receiving element 13 are stored with respect to the sources of the received light, i.e., the fire-observation light emitting device 10 and the shield-observation light emitting device 30, a received light data memory 17 for storing received light data of light from the fire-observation light emitting device 10, a received light data memory 37 for storing received light data of light from the shield-observation light emitting device 30, a calculation section 39 for calculating the quantity of reflected light from a shielding object by using the two groups of received light data, a threshold value setting section 18 for previously setting a threshold value for fire detection, and a fire judgement section 19 for determining whether or not there is a fire on the bassi of the threshold value. The operation of changing the groups of received light data by the changeover switch 34 is performed simultaneously with the time when the changeover control section 32 changes the emission of light between the fire-observation light emitting device 10 and the shield-observation light emitting device 30.

In this embodiment, a collimator lens 51 for collimating light is provided in front of each of the fire-observation light emitting device 10 and the shield-observation light emitting device 30, and a condenser lens 52 for condensing reflected light from the reflecting plate 2 is provided in front of the light receiving element 13.

In this embodiment, a retroreflection mirror is used as the reflecting mirror 2. Light emitted from the fire-observation light emitting device 10 is collimated by the collimator lens 51 and is turned by 180° by the reflecting plate 2 to travel to the light receiving portion 5 of the sensor main unit 1. However, light emitted from the shield-observation light emitting device 30 does not travel directly to the light receiving portion 5 after being returned by the reflecting plate 2 because of a different incident angle upon the reflecting plate 2.

The operation of the thus-constructed first embodiment will be described below.

In this embodiment, the fire-observation light emitting device 10 and the shield-observation light emitting device 30 are alternately lighted intermittently in predetermined cycles.

Figure 3A:
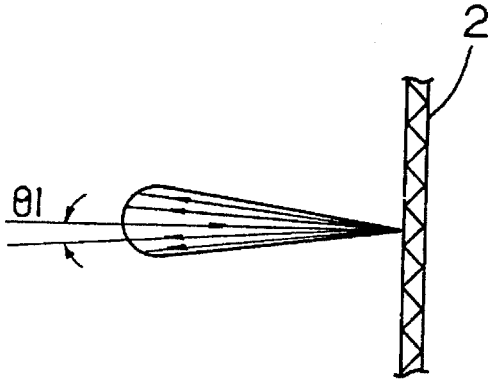
FIGS. 3(*a*) and 3(*b*) are diagrams of a state of reflection of a light beam on a reflecting plate formed of a retroreflection mirror.
Figure 3B:
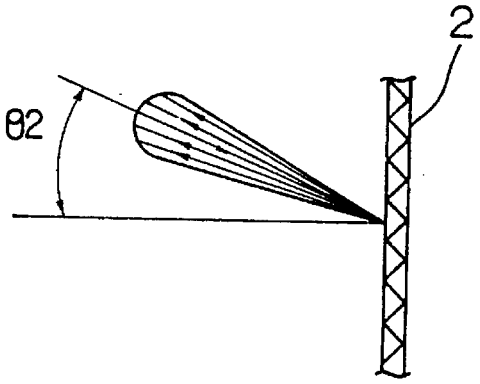

As mentioned above, in this embodiment, only light emitted from the fire-observation light emitting device 10 is returned by the reflecting plate 2 so as to travel directly to the light receiving device 13, and substantially no part of light emitted from the shield-observation light emitting device 30 is received by the light receiving device 13. This relationship is shown in FIGS. 3(*a*) and 3(*b*).

That is, the retroreflection mirror has a characteristic such that light is reflected so as to travel along the path in which it is incident upon the mirror. Accordingly, light emitted from the fire-observation light emitting device 10 is reflected generally frontward, as shown in FIG. 3(*a*). Therefore, the reflected light can reach the light receiving device 13 disposed in a direction at an angle $\theta_1$ to the incident light beam (e.g., 0.02° if the observation distance is 50 m and the distance between the fire-observation light emitting device 10 and the light receiving device 13 is 20 mm).

On the other hand, the shield-observation light emitting device 30 is disposed in a position deviated from the optical axis connecting the fire-observation light emitting device 10, the reflecting plate 2 and the light receiving device 13. Therefore, light emitted from the shield-observation light emitting device 30 is obliquely incident upon the reflecting plate 2 and is reflected to travel in a direction along the incident path, as shown in FIG. 3(*b*). Accordingly, only a very small part of the reflected light can reach the light receiving device 13 disposed in a direction at an angle 82 to that optical axis (0.37° under the above-mentioned conditions).

Figure 4:
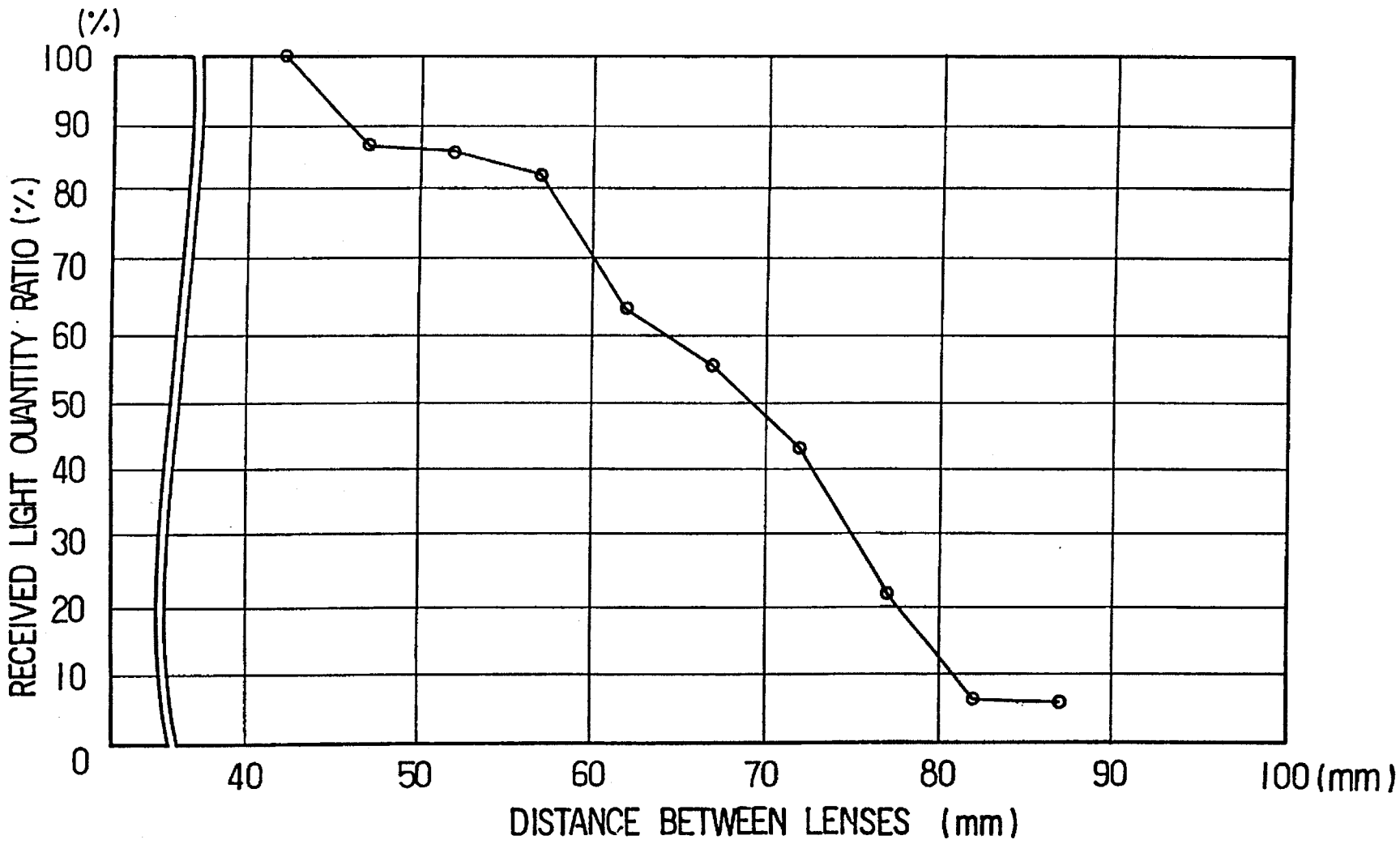
FIG. 4 is a graph of the relationship between the quantity of received light and the distance between a light emitting device and a light receiving device.
Figures 5, 6:
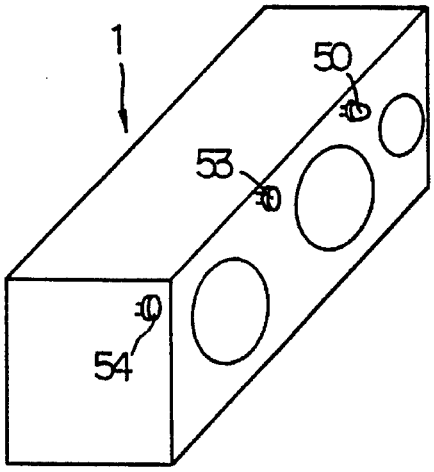
FIG. 5 is a table of the relationship between the observation distance and received light quantity ratios.
FIG. 6 is a perspective view of the construction of a main unit of a separate type photoelectric smoke sensor in accordance with a second embodiment of the present invention.

Thus, in an ordinary situation (where there are no smoke and no shielding object),-light incident upon the light receiving device 13 is mainly reflected light of the light emitted from the fire-observation light emitting device 10. FIG. 4 shows experimentally-obtained data on the distance between the light emitting device 10 and the light receiving device 13 (the distance between the lenses) and the quantity of light received by the light receiving device 13. As can be understood from FIG. 4, the distance between the light emitting device 10 and the light receiving device 13 and the quantity of received light are substantially in a relationship expressed by a linear equation. The ratio of the quantities of light received by the light emitting device 10 and the light receiving device 13 also changes with respect to the observation distance. The relationship between these factors is as shown in FIG. 5. Accordingly, the position at which the main unit 1 of the sensor is set is determined by previously fixing the ratio of the two quantity of light to, for example, 10:1 and by selecting the observation distance so as to set this ratio.

The operation in a situation where a shielding object 9, such as that shown in FIG. 1, exists in the observed region will be explained below. Light emitted from the light emitting device 10 or 30 travels to the shielding object 9 and is reflected by this object. Light emitted and reflected in this manner is incident upon the light receiving device 13 along with reflected light from reflecting plate 2. That is, for correct fire judgement, it is necessary to use a light quantity value obtained by subtracting the quantity of the reflected light from the shielding object from the quantity of the received light.

In accordance with the present invention, the quantity of reflected light from the shielding object is determined by a method described below.

First, the ratio of the quantity of light x1 received by the light receiving device 13 when the fire-observation light emitting device 10 is lighted and the quantity of light x2 received by the light receiving device 13 when the shield-observation light emitting device 30 is lighted in a situation where there is no shielding object is set. This is a value determined by the distance between the light emitting devices 10 and 30, as mentioned above. In this embodiment, if the observation distance if 50 m, x1: x2=10:1.

If the quantity of light received by the light receiving device 13 when the light emitting device 10 is lighted and the quantity of light received by the light receiving device when the light emitting device 30 is lighted in a case where a shielding object exists are A1 and A2, respectively, each of A1 and A2 is the sum of the light quantity x1 or x2 and the corresponding quantity of received reflected light from the shielding object. That is, if the quantities of reflected light from the shielding object caused by lighting of the light emitting devices 10 and 30 are B1 and B2, A1 and A2 can be expressed as follows:

$$A1=B1+x1.X$$

$A2=B2+x2.X$

Reflected light from the shielding object is scattered light. Therefore, the influence of the distances from the light emitting devices 10 and 30 upon the quantities of light is small and, substantially, B1=B2=B. Accordingly, B can be calculated by simultaneously solving these equations from data on A1 and A2 actually measured.

In this embodiment, the above-described calculation is performed by the calculation section 39. That is, data is read from the received data memories 17 and 37 and the quantity of reflected light (B) from the shielding object is calculating from the data by using the predetermined ratio of x1 and x2.

After the quantity of reflected light from the shielding objet has been calculated in this manner, the difference between the quantity of received light and the quantity of reflected light when the fire-observation light emitting device 10 is lighted is calculated to obtain the true quantity of reflected light from the reflecting plate 2. Then, in the fire judgement section 19, the thus-obtained value and the threshold value previously set in the threshold value setting section 18 are compared to determine whether or not there is a fire.

This series of calculations are performed each time the light emitting devices 10 and 30 are intermittently lighted. That is, fire-judgment is performed by comparing the present data with the immediately preceding data. Therefore, correct fire-judgement can be effected even if the influence of other shielding objects is newly added, or even if the quantity of reflected light from one shielding object is changed.

Figure 7:
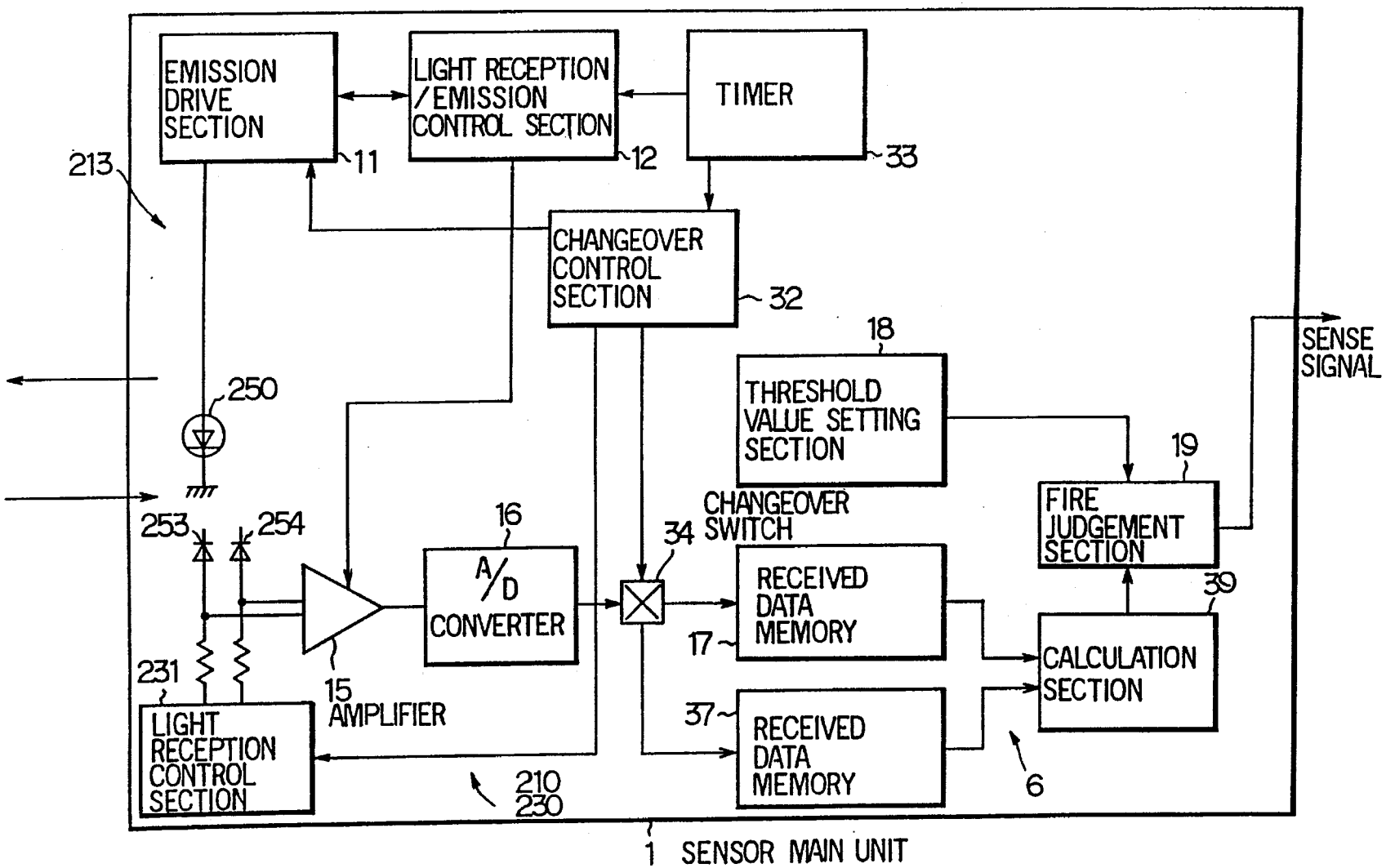
FIG. 7 is a block diagram of the construction of a main unit of the sensor shown in FIG. 6.

FIG. 6 is a perspective view of a main unit 1 of a sensor in accordance with the second embodiment of the present invention, and FIG. 7 is a block diagram of the construction of this sensor.

In this embodiment, two light receiving devices are provided, while two light emitting devices are provided in the first embodiment.

The construction of the main unit 1 of this embodiment is generally the same as that of the first embodiment shown in FIG. 2, but differs in that two light receiving devices, i.e., fire-observation light receiving device 53 and a shield-observation light receiving device 54 are provided in place of the light receiving element 13, and that only one light emitting device (light emitting device 50) is used. Also in this embodiment, a light reception changeover control section 231 is provided in place of the emission changeover control section 31. By a command from the changeover control section 32, one of the light receiving devices is selected to receive light and one of the data memories is selected to store received light data.

In this embodiment, the light emitting device 50 is intermittently lighted. In synchronization with this lighting, the light receiving device for receiving reflected light thereby caused is changed. In this case, reflected light from a reflecting plate 2 is directly incident upon the fire-observation light receiving device 53 in accordance with the principle described above with respect to the first embodiment. Substantially no reflected light from the reflecting plate 2 is incident upon the shield-observation light receiving device 54. The distance between the light receiving devices 53 and 54 is selected so that the ratio of the quantities of incident light is set to a predetermined value, as in the case of the first embodiment.

Accordingly, also in this embodiment, simultaneous equations are solved in a calculation section 39 on the basis of received light data to obtain the quantity of reflected light from a shielding object in the same manner as the first embodiment. The true quantity of reflected light is thereby determined and is compared with a threshold value in a fire judgement section 19 to determine whether or not there is a fire.

Figure 8:
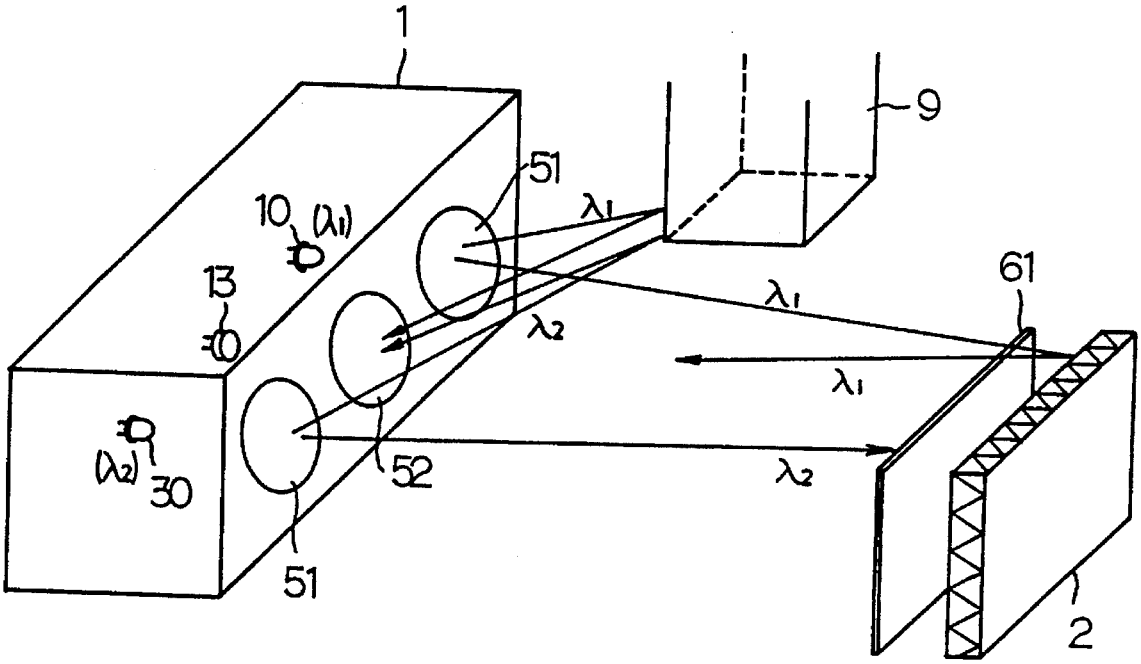
FIG. 8 is a perspective view of the overall construction of a separate type photoelectric smoke sensor in accordance with a third embodiment of the present invention.

Next, third and fourth embodiments of the present invention will be described. FIG. 8 is a perspective view of the overall construction of the third embodiment. The third and fourth embodiments are arranged to use an optical filter for transmitting light of a particular wavelength so that only light of the particular wavelength returns from a reflecting plate 2. In this case, during shield observation in an ordinary situation, this optical filter serves to inhibit reflected light from the reflected plate 2 from being received. Therefore, the true quantity of reflected light from the reflecting plate 2 can be obtained on the basis of the difference between the quantity of light received during fire observation and the quantity of light received during shield observation.

That is, as shown in FIG. 8, a fire-observation light emitting device 10 (fire-observation light emitting section) for emitting light of wavelength $\lambda_1$ (first wavelength), a shield-observation light emitting device 30 (shield-observation light emitting section) for emitting light of wavelength $\lambda_2$ (second wavelength) at the same emission intensity and with the same diffusion characteristic as the fire-observation light emitting device 10, and a light receiving device 13 (light receiving section) having no wavelength-dependency are provided in a sensor main unit 1. A filter 61 for transmitting only light of wavelength $\lambda_1$ is disposed in front of the reflecting plate 2.

The construction of the main unit 1 is the same as that shown in FIG. 2 and details thereof will not be described. The main unit 1 of this embodiment, however, differs in that fire-observation light emitting device 10 emits near infrared light of wavelength $\lambda_1$ and the shield-observation light emitting device 30 emits near infrared light of wavelength $\lambda_2$.

A retroreflection mirror is used as a reflecting plate 2. In this embodiment, however, the filter 61 for transmitting only light of wavelength $\lambda_1$ is provided in front of the retroreflection mirror.

Accordingly, light of wavelength $\lambda_1$ emitted from the fire-observation light emitting device 10 passes through the filter 61 and reaches the reflecting plate 2. This light is turned by the reflecting plate 2 by 180° and is received by the light receiving section 5 of the sensor main unit 1. However, light of wavelength $\lambda_2$ emitted from the shield-observation light emitting device 30 is cut the filter 61 and cannot reach the reflecting plate 2. This light is not received by the light receiving section 5.

The operation of the thus-constructed separate type photoelectric smoke sensor of this embodiment will be described below with reference to FIGS. 9 and 10 [(*a*) and (*b*) of both].

Figures 9A, 9B:
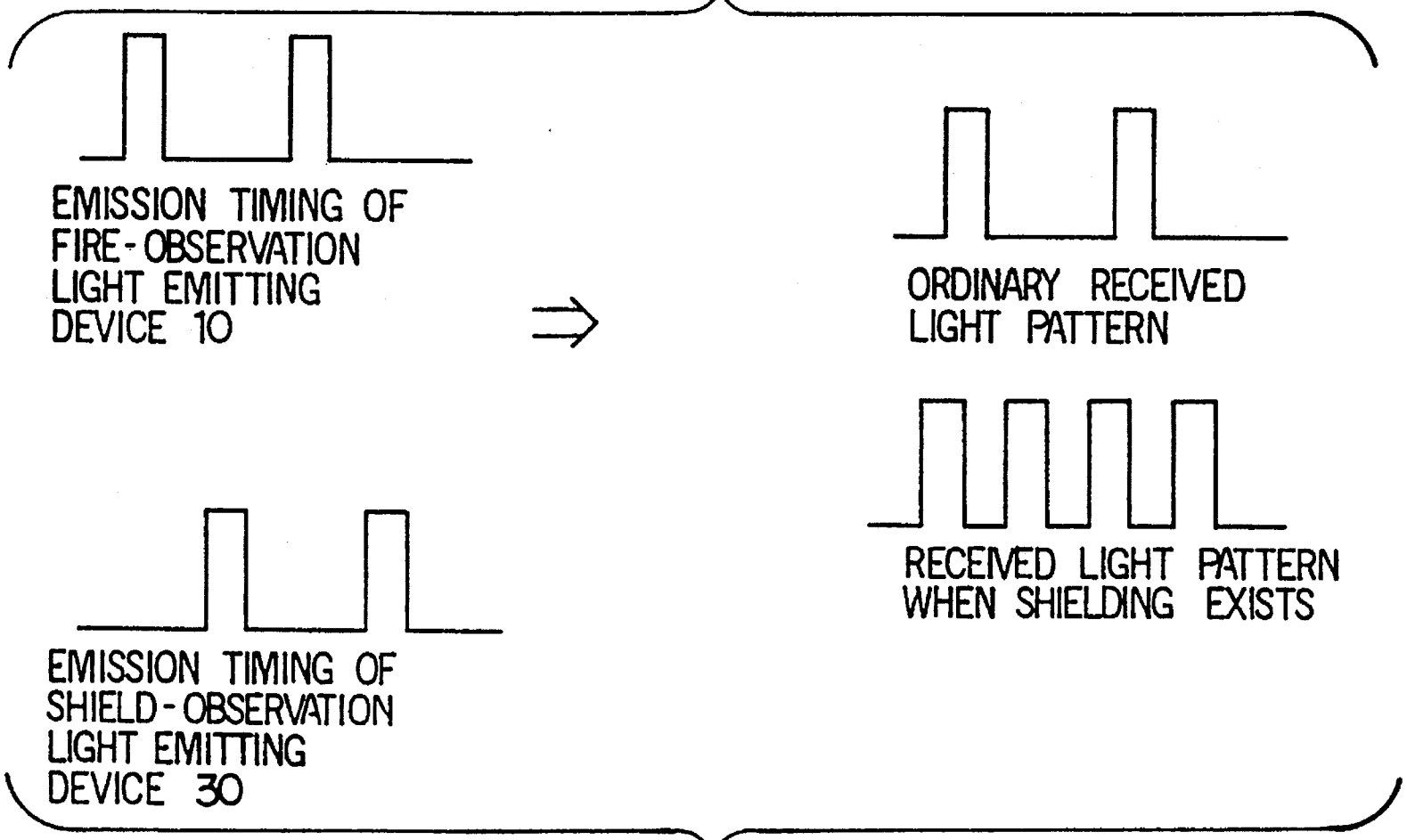
FIGS. 9(*a*) and 9(*b*) are diagrams of received light patterns in the sensor shown in FIG. 8.
Figure 10A:
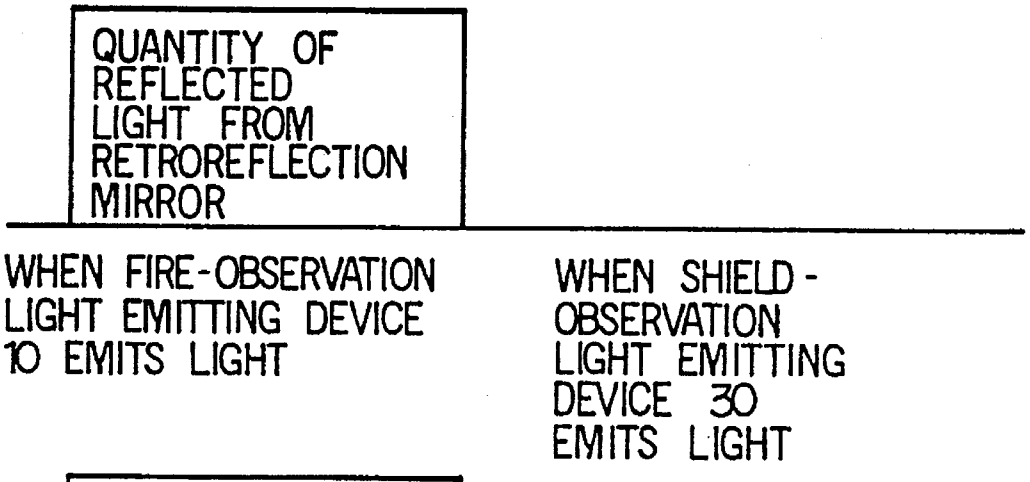
FIGS. 10(*a*) and 10(*b*) are diagrams of the quantity of received light in the sensor shown in FIG. 8.
Figure 10B:
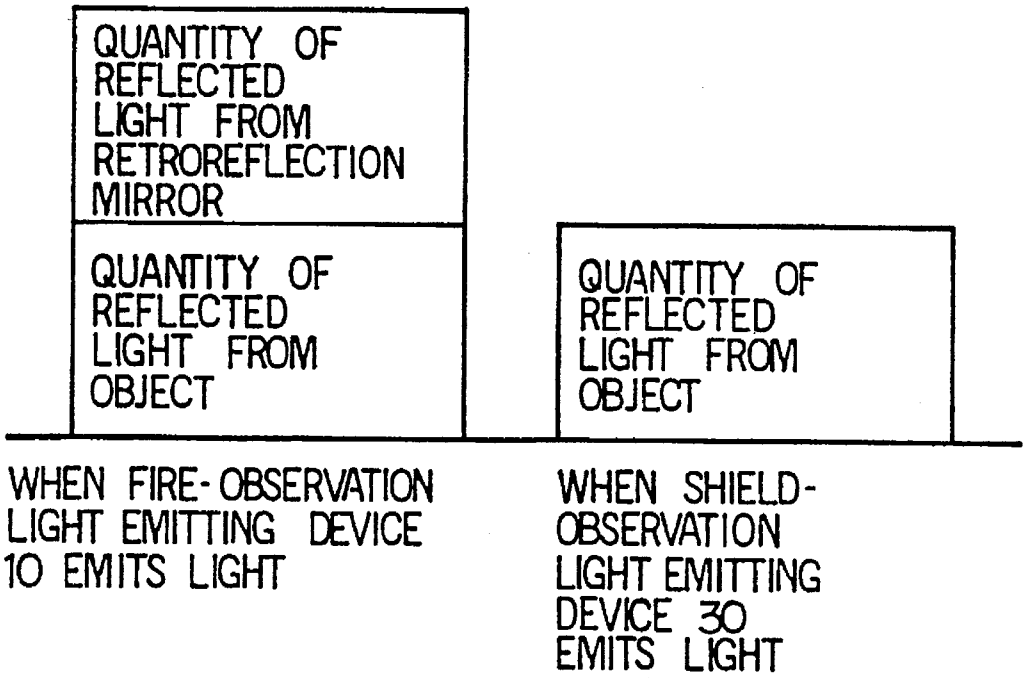

FIGS. 9(*a*) and 9(*b*) are diagrams of received light patterns in the separate type photoelectric smoke sensor of this embodiment, and FIGS. 10(*a*) and 10(*b*) are diagrams of corresponding quantities of received light.

In this embodiment, the fire-observation light emitting device 10 and the shield-observation light emitting device 30 are alternately lighted intermittently in predetermined cycles. In this case, as mentioned above, only light emitted from the fire-observation light emitting device 10 is returned by the reflecting plate to the light receiving device 13 in an ordinary situation, while light emitted from the shield-observation light emitting device 30 is not received by the light receiving device 13, because of the difference between the wavelengths.

In an ordinary situation, as shown in FIG. 8, light of wavelength $\lambda_1$ emitted from the fire-observation light emitting device 10 is collimated by a collimator lens 51 to travel toward the reflecting plate 2. Since the filter 61 placed in front of the reflecting plate 2 transmits only light of wavelength $\lambda_1$, the light of wavelength $\lambda_1$ from the fire-observation light emitting device 10 reaches the reflecting plate 2. The light reflected by the reflecting plate 2 travels in the direction along the path of the incident beam by the effect of the retroreflection mirror to be received by the light receiving device 13.

On the other hand, light of wavelength $\lambda_2$ emitted from the shield-observation light emitting device 30 also travels toward the reflecting plate 2 as in the case of the light emitted from the fire-observation light emitting device 10. in this case, however, the light of wavelength $\lambda_1$ from the shield-observation light emitting device 30 cannot reach the reflecting plate 2, since the filter 61 transmits only light of wavelength $\lambda_1$.

Accordingly, in an ordinary situation, a received light pattern such as that shown in FIG. 9(*a*) is formed by the alternate emission of light from the devices 10 and 30. In this state, the quantity of received light is obtained as shown in FIG. 10(*a*). The light receiving device 13 receives light only when the fire-observation light emitting device 10 emits light.

The operation in a situation where a shielding object 9 exists in the observed region as shown in FIG. 8 will be explained below.

In accordance with the present invention, the quantity of reflected light from the shielding object is determined by utilizing a phenomenon wherein the shielding object 9 reflects light from the light emitting devices 10 and 30 irrespective of the wavelength.

That is, in a case where a shielding object 9 exists, a received light pattern is formed as shown in FIG. 9(*b*) when the fire-observation light emitting device 10 emits light. The quantity of received light is thereby obtained as shown in FIG. 10(*b*), i.e., as the sum of the quantity of reflected light from the reflecting plate 2 and the quantity of reflected light from the shielding object 9 (wavelength $\lambda_1$).

On the other hand, when shield-observation light emitting device 30 emits light, the quantity of light received by the light receiving device 13 includes only the quantity of reflected light from the shielding object 9 (wavelength $\lambda_2$), as shown in FIG. 10(*b*), since the light emitting devices 10 and 30 have the same emission intensity and the same diffusion characteristics; the shielding object 9 reflects light from the light emitting devices 10 and 30 irrespective of the wavelength; the light receiving device 13 has no wavelength dependency; and reflected light from the reflecting plate 2 is not returned to the sensor by the effect of the filter 61. Consequently, the quantity of reflected light from the shielding object can be known from the quantity of received light during lighting of the shield-observation light emitting device 30.

In this case, it is not necessary for both light emitting device 10 and 30 to be the same emission intensity and the same diffusion characteristics. It is possible to adjust the level of the quantity of received light from both light emitting devices by correcting the quantity of received light during lighting of each light emitting device based on the quantity of received light from each light emitting device which is known previously.

Figure 11:
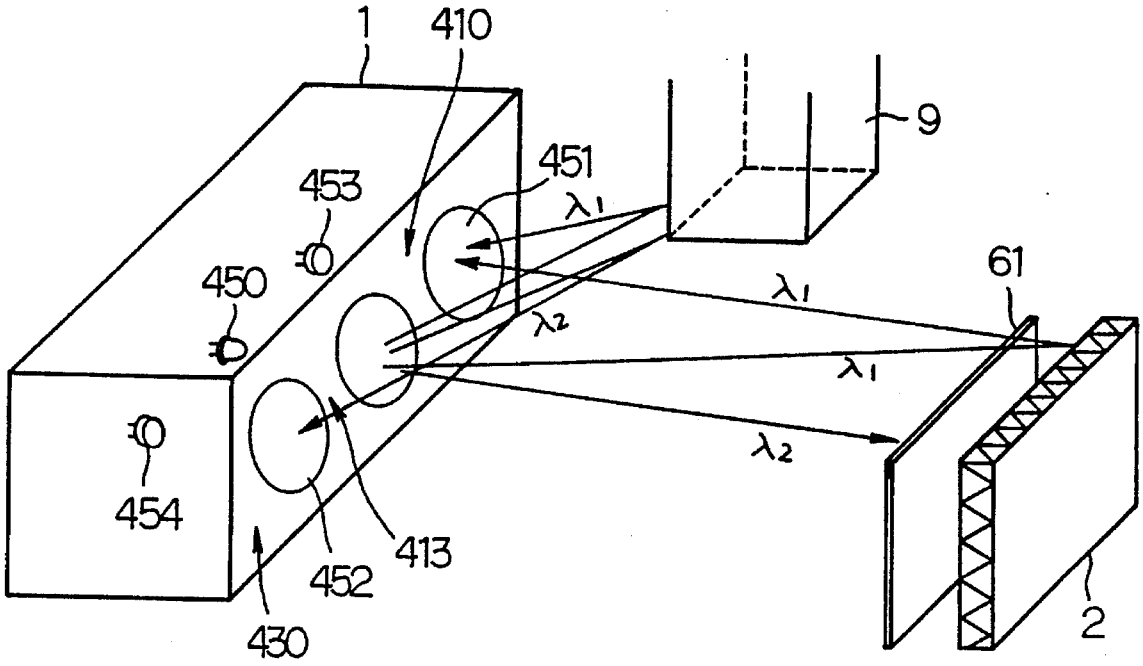
FIG. 11 is a perspective view of the overall construction of a separate type photoelectric smoke sensor in accordance with a fourth embodiment of the present invention.

The fourth embodiment of the present invention will be described below with reference to FIG. 11. FIG. 11 is a perspective view showing the overall construction of this embodiment.

A light receiving section of a sensor main unit of this embodiment includes a fire-observation light receiving section 410 having a filter 451 for transmitting only light of a predetermined first wavelength $\lambda_1$, and a shield-observation light receiving section 430 having a filter 452 for transmitting only light of a predetermined second wavelength $\lambda_2$. In these light receiving sections are respectively provided light receiving devices 453 and 454 having a wavelength dependency of light receiving sensitivity in the range of wavelengths $\lambda_1$ and $\lambda_2$. A light emitting section 413 has a light emitting device 450 capable of emitting light having both the first and second wavelengths $\lambda_1$ and $\lambda_2$. A filter 61 for transmitting only light of first wavelength $\lambda_1$ is disposed in front of a reflecting plate 2.

To determine whether or not there is a fire, the quantities of light received by the fire-observation light receiving section 410 and the shield-observation light receiving section 430 are compared and the difference therebetween is compared with a threshold value previously set.

The light emitting section 413 emits light having both the first and second wavelengths $\lambda_1$ and $\lambda_2$. At this time, since the filter which transmits only light of the first wavelength $\lambda_1$ is disposed in front of the reflecting plate 2, reflected light from the reflecting plate 2 is light of the first wavelength $\lambda_1$. That is, if there is no shielding object, reflected light from the reflecting plate 2 is detected by the fire-observation light receiving section 410 alone, which has the filter 451 which transmits only light of wavelength $\lambda_1$, and is not detected by the shield-observation light receiving section 430 having the filter 452 which transmits only light of wavelength $\lambda_2$.

On the other hand, if there is a shielding plate 9, both reflected light from the shielding object 9 and reflected light from the reflecting plate 2 are returned to the sensor main unit 1. The reflection light returned from the shielding object 9 to the sensor main unit 1 includes light of wavelength $\lambda_1$ and light of wavelength $\lambda_2$. This light is detected by each of the fire-observation light receiving section 410 and the shield-observation light receiving section 430. Therefore, both reflected light from the shielding object 9 and reflected light from the reflecting plate 2 are detected by the fire-observation light receiving section 410, while only reflected light from the shielding object 9 is detected by the shield-observation light receiving section 430.

In this case, since the light receiving sections 410 and 430 have no wavelength dependency with respect to the quantity of received light, the quantity of light reflected by the shielding object 9 and received by the fire-observation light receiving section 410 and the quantity of light reflected by the shielding object 9 and received by the shield-observation light receiving section 430 are regarded as equal to each other. Accordingly, the true quantity of light received from the reflecting plate 2 is obtained by calculating the difference between the quantity of light received by the fire-observation light receiving section 410 and the quantity of light received by the shield-observation light receiving section 430. The true quantity of light thereby obtained is used to determine whether or not there is a fire. Also in this case, other processing operations are the same as those of the third embodiment.

Figure 12:
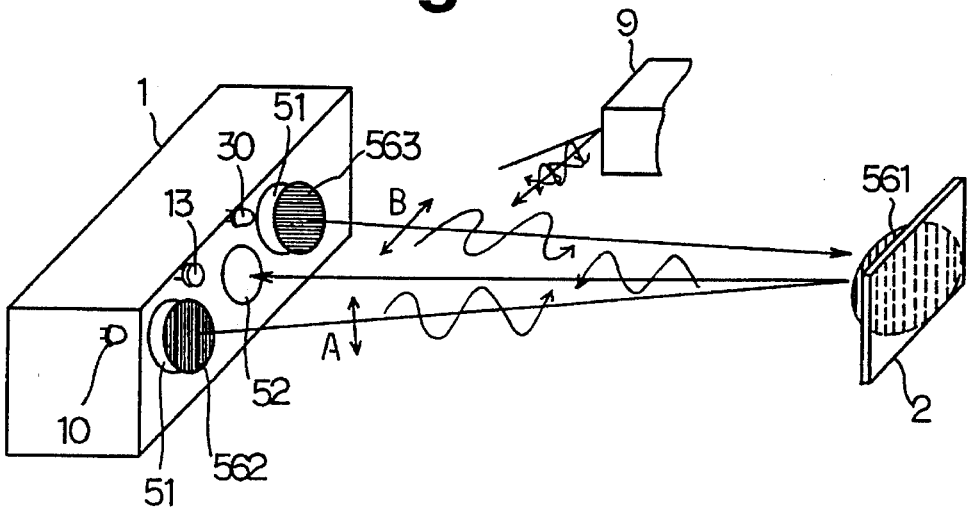
FIG. 12 is a perspective view of the overall construction of a separate type photoelectric smoke sensor in accordance with a fifth embodiment of the present invention.

Fifth, sixth and seventh embodiments of the present invention will be described below. FIG. 12 is a perspective view of the overall construction of the fifth embodiment of the present invention. Sensors in accordance with the fifth, sixth and seventh embodiments are arranged in such a manner that polarization filters are used to return only light polarized in a particular direction from a reflecting plate 2, and that no reflected light is received during shield observation in an ordinary situation (where there are no smoke and no shielding object).

In the fifth embodiment, as shown in FIG. 12, a fire-observation light emitting device 10, a shield-observation light emitting device 30 which is the same as the fire-observation light emitting device 10, and a light receiving device 13 are provided in a sensor main unit 1. A first polarization filter 561 is disposed in front of the reflecting plate 2, a second polarization filter 562 is disposed in front of the fire-observation light emitting device 10, and a third polarization filter 563 is disposed in front of the shield-observation light emitting device 30. The construction of the sensor main unit 1 is the same as that shown in FIG. 2 and details thereof will not be described.

In this embodiment, collimator lenses 51 are provided in front of the fire-observation light emitting device 10 and the shield-observation light emitting device 30, and the second polarization filter 562 and the third polarization filter 563 having planes of polarization different from each other by 90° are disposed in front of the collimator lenses 51.

The first polarization filter 561 disposed in front of the reflecting plate 2 formed of a retroreflection mirror has the same plane of polarization as the second polarization filter 562 disposed in front of the fire-observation light emitting device 10. Accordingly, light emitted from the fire-observation light emitting device 10 is collimated by the collimator lens 51 and is polarized by the second polarization filter 561. Since the first and second polarization filters 561 and 562 have the same planes of polarization, this light passes through the first polarization filter 561 to reach the reflecting plate 2, and is turned by 180° by the reflecting plate 2 to be received by the receiving section 5 of the sensor main unit 5. However, light emitted from the shield-observation light emitting device 30 cannot reach the reflecting plate 2 and cannot be returned to be received by the light receiving section 5, because the plane of polarization of this light is shifted by 90° by the third polarization filter.

The operation of the thus-arranged fifth embodiment will be described below.

In this embodiment, the fire-observation light emitting device 10 and the shield-observation light emitting device 30 are alternately lighted intermittently in predetermined cycles.

As mentioned above, in this embodiment, only light emitted from the fire-observation light emitting device 10 is returned by the reflecting plate 2 to travel to the light receiving device 13 by the effect of the different planes of polarization of the polarization filters, while substantially no part of light emitted from the shield-observation light emitting device 30 is received by the light receiving device 13. That is, in an ordinary situation, as shown in FIG. 12, light emitted from the shield-observation light emitting device 30 travels toward the reflecting plate 2 while being polarized in a direction A by the second polarization filter 562. Since the first polarization filter 561 disposed in front of the reflecting plate 2 is also a direction A polarization filter, the light from the fire-observation light emitting device reaches the reflecting plate 2 and is reflected to travel along the path in which it is incident upon the reflecting plate 2, because of the characteristics of the retroreflection mirror, and is received by the light receiving device 13.

On the other hand, light emitted from the shield-observation light emitting device 30 travels toward the reflecting plate while being polarized in a direction B by the third polarization filter 563. In this case, the light from the shield-observation light emitting device 30 polarized in direction B cannot reach the reflecting plate 2, since the first polarization filter 561 is a direction A polarization filter.

Figure 13A:
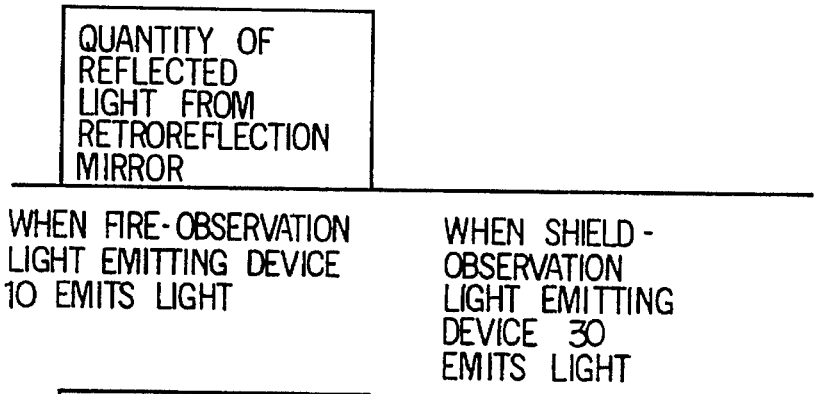
FIGS. 13(*a*) and 13(*b*) are diagrams of the quantity of received light in the sensor shown in FIG. 12.
Figure 13B:
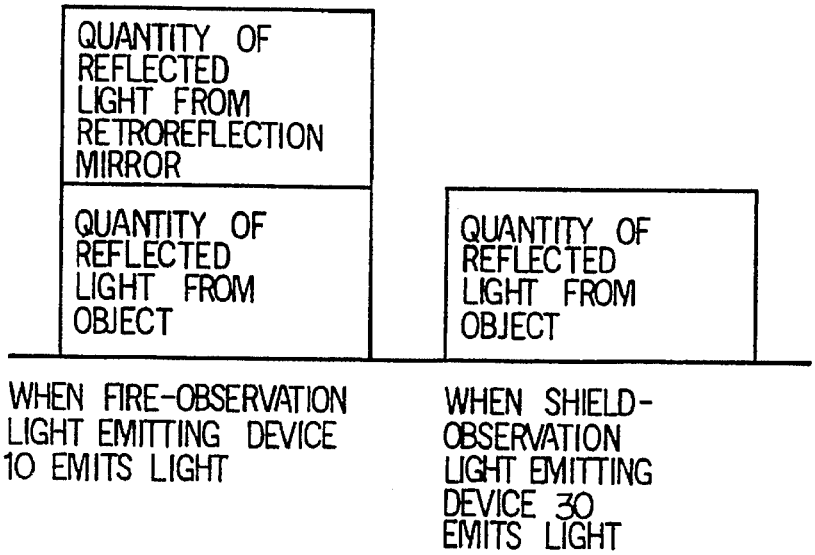

Accordingly, in an ordinary situation, as shown in FIG. 13(*a*), the light receiving device 13 receives light only when the fire-observation light emitting device 10 omits light.

The operation in a situation where a shielding object 9 exists in the observed region as shown in FIG. 8 will be explained below.

In this situation, light emitted from each of the light emitting devices 10 and 30 travels to the shielding object 9 and is reflected by this object. In accordance with the present invention, the quantity of reflected light from the shielding object is determined by utilizing a phenomenon wherein the shielding object 9 reflects light from the light emitting devices 10 and 30 irrespective of the wavelength.

That is, in a case where a shielding object 9 exists, the quantity of received light when the fire-observation light emitting device 10 is obtained as the sum of the quantity of reflected light from the reflecting plate 2 and the quantity of reflected light from the shielding object 9, as shown in FIG. 13(*b*). On the other hand, the quantity of received light when the shield-observation light emitting device 30 is obtained as the quantity of reflected light from the shielding object 9 alone, since no reflected light from the reflecting plate 2 is received. Accordingly, the quantity of reflected light from the shielding object 9 can be known from the quantity of received light when the shield-observation light emitting device 30 emits light.

Figure 14:
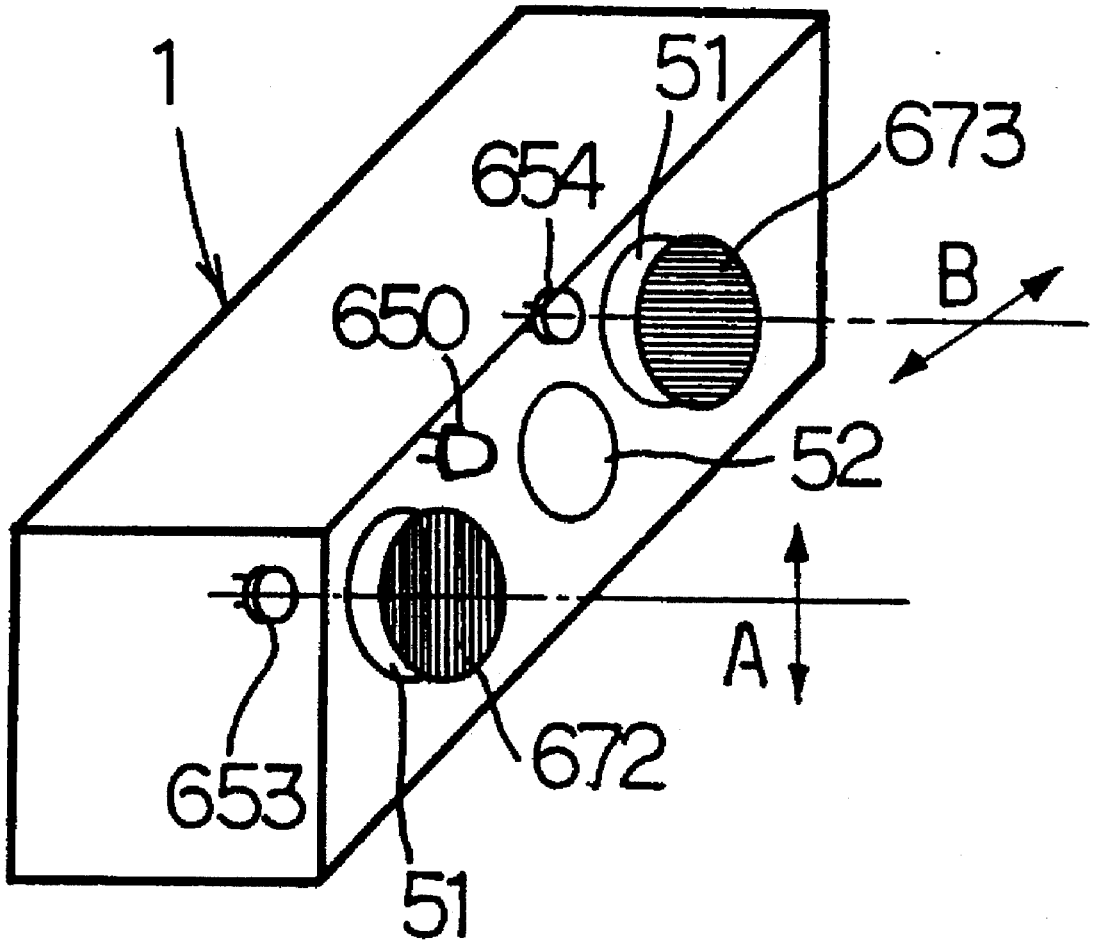
FIG. 14 is a perspective view of the construction of a main unit of a separate type photoelectric smoke sensor in accordance with a sixth embodiment of the present invention.

The sixth embodiment of the present invention will be described below with reference to FIG. 14. FIG. 14 is a perspective view of a sensor main unit 1.

This embodiment has one light emitting device and two light receiving devices, i.e., a fire-observation light receiving device 653 and a shield-observation light receiving device 654, while the fifth embodiment has two light emitting devices and one light receiving device. A second polarization filter 672 and a third polarization filter 673 having planes of polarization different from each other by 90° are respectively disposed in front of the light receiving devices. The second polarization filter 672 in front of the fire-observation light receiving device 653 has the same plane of polarization (in direction A) as a first polarization filter 561 in front of the reflecting plate 2.

The construction of the sensor main unit 1 of this embodiment is generally the same as that of the fifth embodiment, but differs in that two-light receiving devices, i.e., the fire-observation light receiving device 653 and the shield-observation light receiving device 654 are provided in place of the light receiving device 13, and that only one light emitting device (light emitting device 650) is provided.

In this embodiment, the light emitting device 650 is intermittently lighted. In synchronization with this lighting, the light receiving devices for receiving reflected light caused by this lighting are changed. In this case, non-polarized light emitted from the light emitting device 650 is polarized in a direction A by the first polarization filter 561 and is reflected by the reflecting plate 2. Accordingly, reflected light from the reflecting plate 2 is incident upon the fire-observation light receiving device 654 provided with the second polarization filter 562 having the same plane of polarization as the first polarization filter 561 in accordance with the same principle as that described above with respect to the fifth embodiment. On the other hand, reflected light traveling from the reflecting plate 2 toward the shield-observation light receiving device 653 is cut by the third polarization filter 673 because of its different polarizing direction (direction B). The quantity of received light is obtained as shown in FIG. 15(*a*) in this case.

The operation in a situation where a shielding object 9 exists in the observed region will be explained below. In this case, since light emitted from the light emitting device 650 is non-polarized light, reflected light from the shielding object 9 also is non-polarized light.

Therefore, at the time of reception through the fire-observation light receiving device 653, reflected light from the reflecting mirror 2 and a direction-A component of reflected light from the shielding object 9 are received, as shown in FIG. 15(*b*).

At the time of reception through the shield-observation light receiving device 654, a direction-B component of reflected light from the shielding object 9 is received. Since the reflected light from the shielding object 9 is scattered and non-polarized, the direction-A component and the direction-B component can be regarded as equal to each other. Accordingly, the true quantity of reflected light from the reflecting mirror 2 can be obtained by calculating the difference between the quantity of light received by the fire-observation light emitting device 653 and the quantity of light received by the shield observation light emitting device 654.

Figure 16:
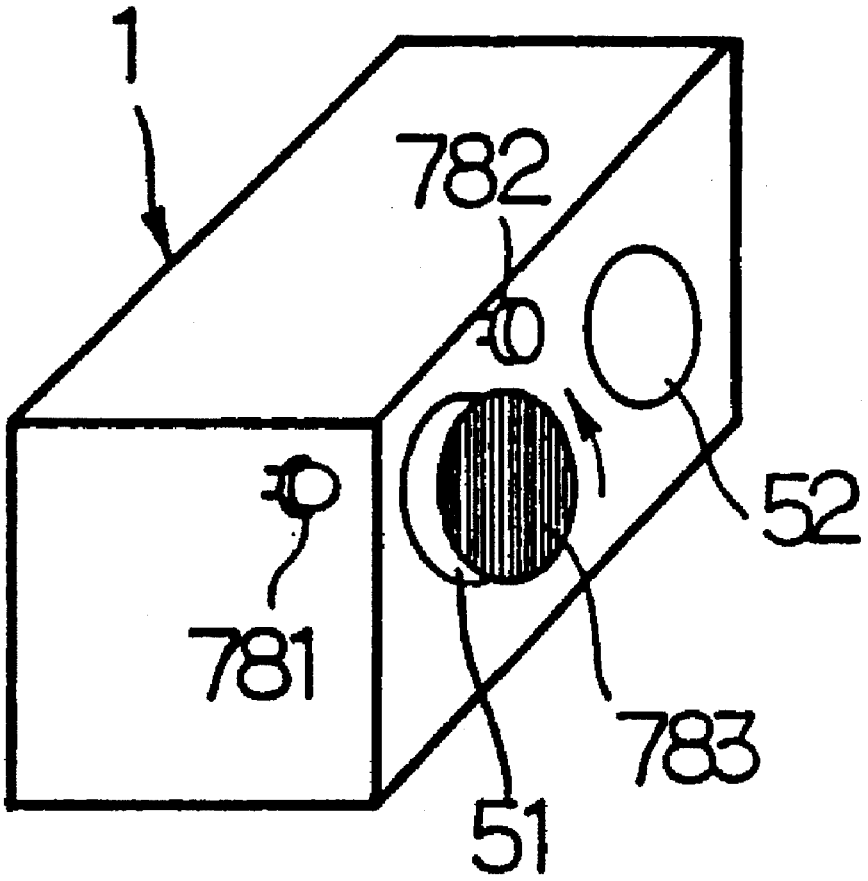
FIG. 16 is a perspective view of the construction of a main unit of a separate type photoelectric smoke sensor in accordance with a seventh embodiment of the present invention.

The seventh embodiment of the present invention will be described below with reference to FIG. 16. In this embodiment, only one light emitting device 781 and only one light receiving device 782 are used and a second polarization filter 783 is disposed in front of the light emitting device 781. The second polarization filter 783 is rotated by 90° at one time by, for example, a stepping motor (not shown). At the time of fire observation, the second polarization filter 783 is stopped at a position such as to have the same plane of polarization as a first polarization filter 563 disposed in front of a reflecting plate 2. At the time of shield observation, the second polarization filter 783 is stopped at a position such as to have a plane of polarization shifted by 90° from that of the first polarization filter 563.

The construction of the sensor main unit 1 of this embodiment also is generally the same as that of the fifth embodiment, but differs in that only one light emitting device 781 is used and that the received light data storage place is changed by a changeover control section 32 in synchronization with the second polarization filter 783 without using emission changeover control section 31.

In this embodiment, the light emitting device 781 is intermittently lighted, as in the case of the sixth embodiment. In synchronization with the lighting, the second polarization filter 783 is rotated and the received light data storage place is changed.

When the second polarization filter 783 is stopped at a position for fire observation at which the polarizing direction thereof coincides with a direction A, it has the same plane of polarization as the first polarization filter 563, and reflecting light from the reflecting plate 2 is received by the light receiving device 782. When the second polarization filter 783 is stopped for shield observation after being rotated by 90°, the polarizing direction coincides with a direction B and no reflected light is received. The principle of this operation is the same as that of the above-described embodiments.

Figure 17:
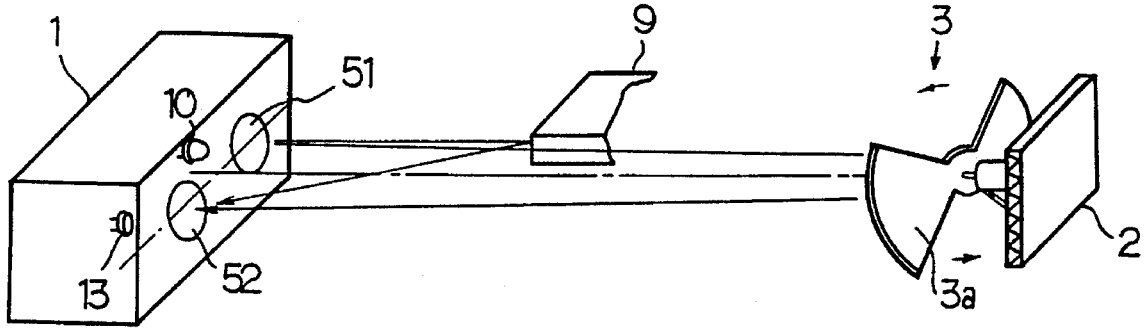
FIG. 17 is a perspective view of the overall construction of a separate type photoelectric smoke sensor in accordance with an eighth embodiment of the present invention.
Figure 18A:
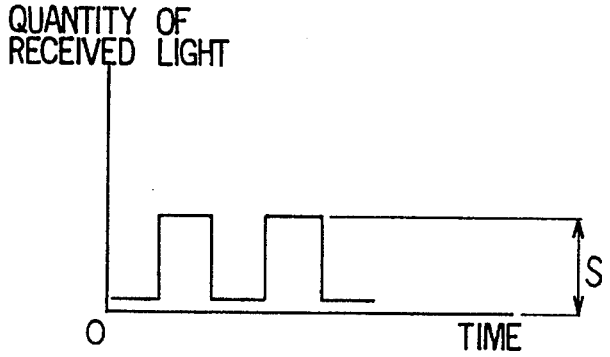
FIGS. 18(*a*) to 18(*d*) are timing charts of the quantity of received light in the sensor shown in FIG. 17.
Figure 18B:
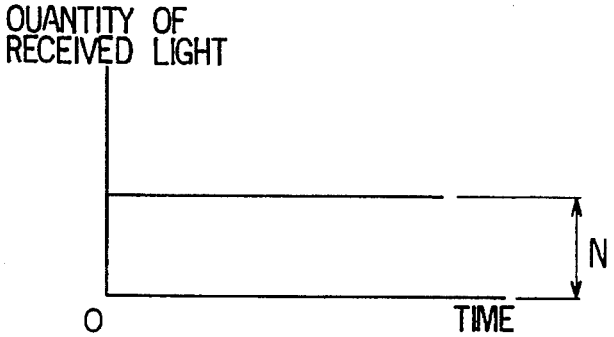
Figure 18C:
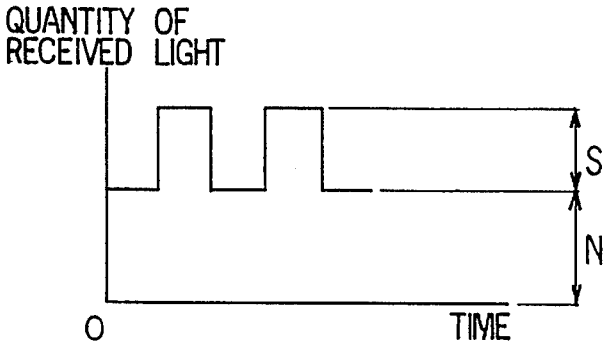
Figure 18D:
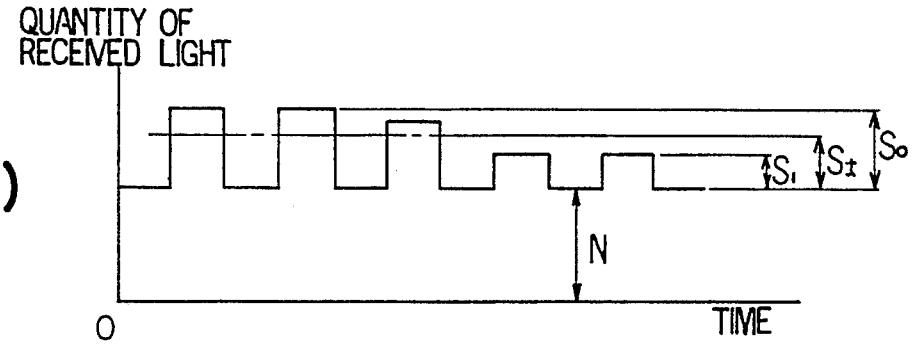

Eighth and ninth embodiments of the present invention will be described below. FIG. 17 is a perspective view of the coverall construction of a separate type photoelectric smoke sensor in accordance with the eighth embodiment of the present invention. In the eighth and ninth embodiments, a chopper having rotating blades or the like is provided in front of a reflecting plate 2.

The construction of this embodiment is generally the same as those of the other embodiments. In this embodiment, however, the emission changeover control circuit 31 and the reception changeover control circuit 231 are not provided. A received light data memory 17 of a judgement section 6 of this embodiment stores received light data obtained when the reflecting plate 2 is exposed, that is, the chopper 3 does not mask the reflecting plate 2 is stored. A received light data memory 37 stores received light data obtained when the chopper 3 is masking the reflecting plate 2.. Further, in this embodiment, a changeover switch 34 changes the received light data in synchronization with the rotation of the chopper 3. A changeover control section 32 controls the rotation of the chopper 3 and the changeover operation of the changeover switch 34, and timer 33 effects a control of these operations with respect to time. By these functions, the place where the received light data is stored is changed according to whether the chopper 3 masks the reflecting plate 2.

In this embodiment, the chopper 3 is provided separately of the sensor main unit 1 and the reflecting plate 2, as illustrated in FIG. 17. The chopper 3 is disposed in front of a surface of the reflecting plate 2 facing the sensor main unit 1. The chopper 3 has a propeller-like shape and has rotating blades 3*a* having a low reflectivity. The chopper 3 is rotated to mask the front surface of the reflecting plate 2.

When one of the rotating blades 3*a* of the chopper 3 is at a position such as to be located in front of the surface of the reflecting plate 2 to intercept light from a light emitting device 10, no light from the light emitting device 10 is incident upon the reflecting plate 2. Since the reflectivity of the rotating blades 3*a* is low, substantially no light from the light emitting device 10 is received by a light receiving device 13. The rotation of the chopper 3 is controlled with the changeover control section 32 because of the need for synchronization with the received light data changeover.

The operation of the thus-arranged eighth embodiment will described below with reference to FIGS. 18(*a*) to 18(*d*). FIGS. 18(*a*), 19(*b*), 18(*c*), and 18(*d*) show received light data (obtained only from reflected light from the reflecting plate 2) in an ordinary situation (where there are no smoke and no shielding object), received light data obtained in a case where there is a shielding object, and corresponding to reflected light from the shielding object alone, received light data actually obtained in a case where there is a shielding object, and received light data obtained in a case where there are a shielding plate and smoke, respectively.

In the ordinary situation, only light traveling from the light emitting device 10 and reflected by the reflecting plate 2 is received by the light receiving device 13. Accordingly, the quantity of received light is changed discontinuously (substantially between O and S), as shown in FIG. 18(*a*). In this case, the light emitting device 10 may be lighted continuously or in a pulsative manner.

If there is a shielding object 9 in the observed region as shown in FIG. 17, reflected light from the shielding object 9 has a constant value (N) as shown in FIG. 18(*b*). Accordingly, data actually obtained in this case is as represented by S+N as shown in FIG. 18(*c*), i.e., the sum of the data shown in FIGS. 18(*a*) and 18(*b*).

In accordance with the present invention, difference between the present data and the immediately preceding data obtained as shown in FIG. 18(*c*) is calculated to determine where or not there is a fire.

In more detail, data obtained in a case where the chopper 3 is masking the reflecting plate 2 is stored in the received light data memory 17 of the sensor main unit 1, while data obtained by exposing the reflecting plate 2 without being masked is stored in the received light data memory 37. Then, these groups of data are read out and the difference therebetween is calculated in a comparison judgment section 39.

That is, the value S shown in FIG. 18(*c*) is obtained. In a fire judgment section 19, the calculated difference is compared with a threshold value to determine whether or not there is a fire.

The operation in a situation where smoke caused by a fire enters the observed region will be explained below. In Light from the light emitting device 10 is scattered by smoke particles and the quantity of light received by the light receiving device is thereby reduced in comparison with the quantity of received light in the ordinary situation, as shown in FIG. 18(*d*). That is, by the intrusion of smoke, the difference between the quantities of received light is reduced from a value S0 in the ordinary situation to S1. If the threshold value is St, the fire judgement section 19 determines that a fire has occurred when S1 becomes smaller than St. For ease of explanation, in FIG. 18(*d*), the quantity of light represented by the constant value (N) is shown as if it is not changed while the amount of invasion of smoke is increased. Needless to say, the constant value (N) is changed by the intrusion of smoke.

Also in this case, the influence of the shielding object can be cancelled because the difference between present data and immediately preceding data is calculated every cycle and is compared with the threshold value in this embodiment.

Figure 19A:
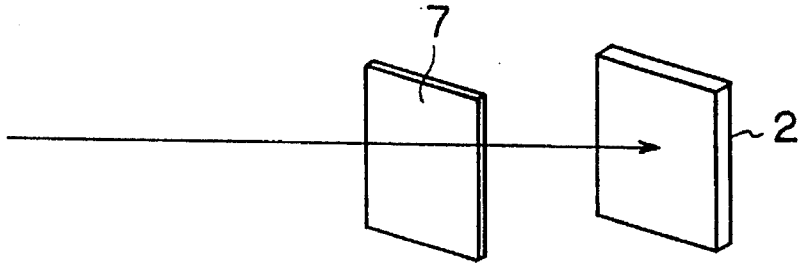
FIGS. 19(*a*) and 19(*b*) are perspective views of a reflecting plate and an optical element on the reflecting plate side of a separate type photoelectric smoke sensor in accordance with a ninth embodiment of the present invention.
Figure 19B:
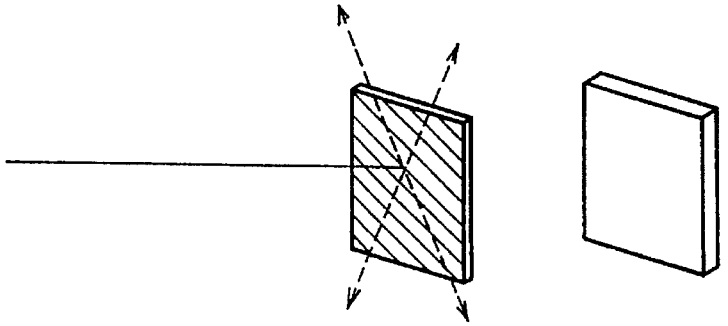

FIG. 19(*a*) and 19(*b*) are perspective views showing the construction of the ninth embodiment of the present invention. A sensor main unit 1 of this embodiment is the same as that of the eighth embodiment, and only components on the reflecting plate 2 sides are therefore illustrated. In this embodiment, an electronic shutter 7 is used in place of the chopper 3 of the eighth embodiment. That is, the electronic shutter 7 is changed between a transparent state (FIG. 19(*a*)) and a shading state (FIG. 19(*b*)) to achieve the same function as the eighth embodiment.

The construction of the sensor main unit 1 and the reflecting plate 2 are the same as those of the eighth embodiment but this embodiment is characterized in disposing the electronic shutter 7 in front of the reflecting plate 2. An electronic shutter on the market, e.g., one utilizing a liquid crystal device, may be used as the electronic shutter 7. However, the reflectivity of a surface of the electronic shutter 7 must be low.

The operation of the electronic shutter 7 is controlled with a changeover control section 32 as in the case of the above-described chopper 3. In synchronization with the shutter operation, received light data is stored and the comparison and judgement operations using the stored data are performed. The fire judgement method and other methods of this embodiment are the same as those of the above-described embodiments.

Figure 20:
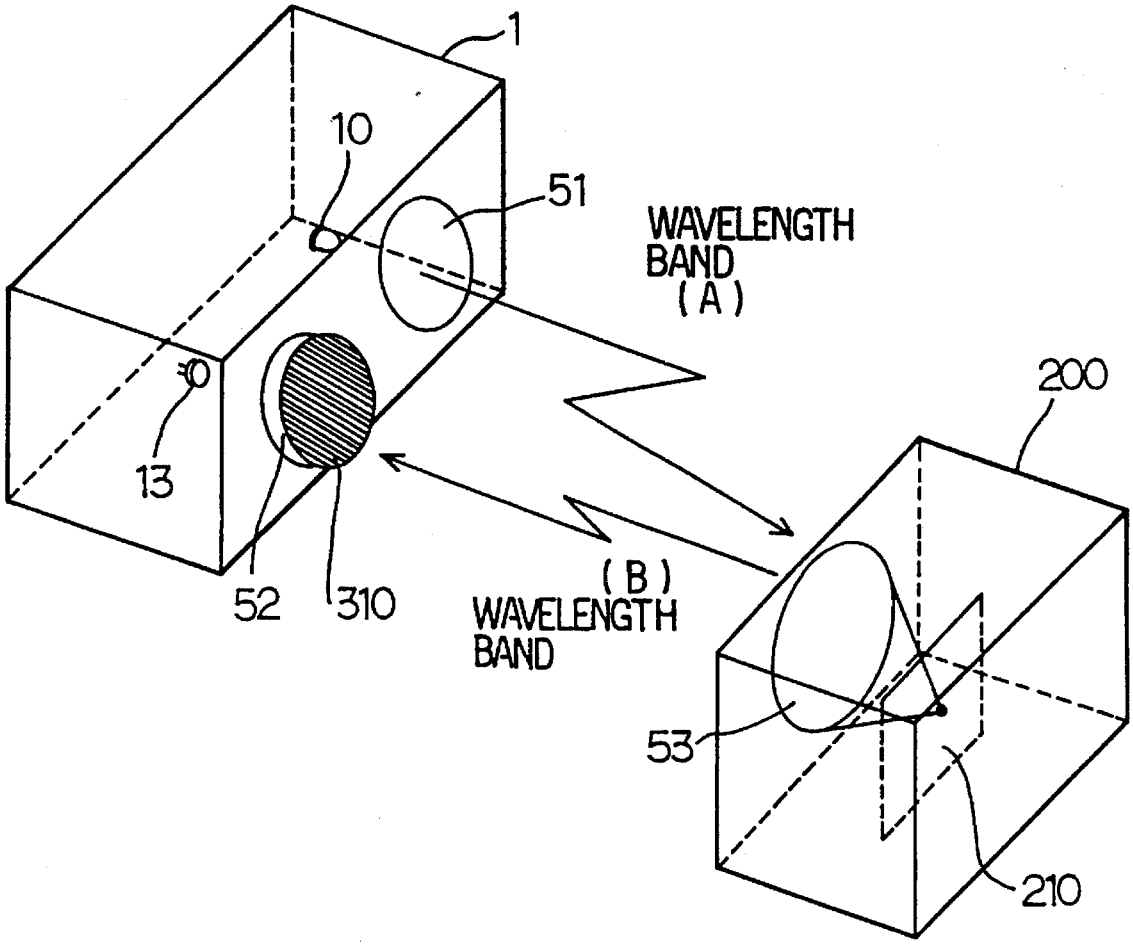
FIG. 20 is a perspective view of the overall construction of a separate type photoelectric smoke sensor in accordance with a tenth embodiment of the present invention.
Figure 21:
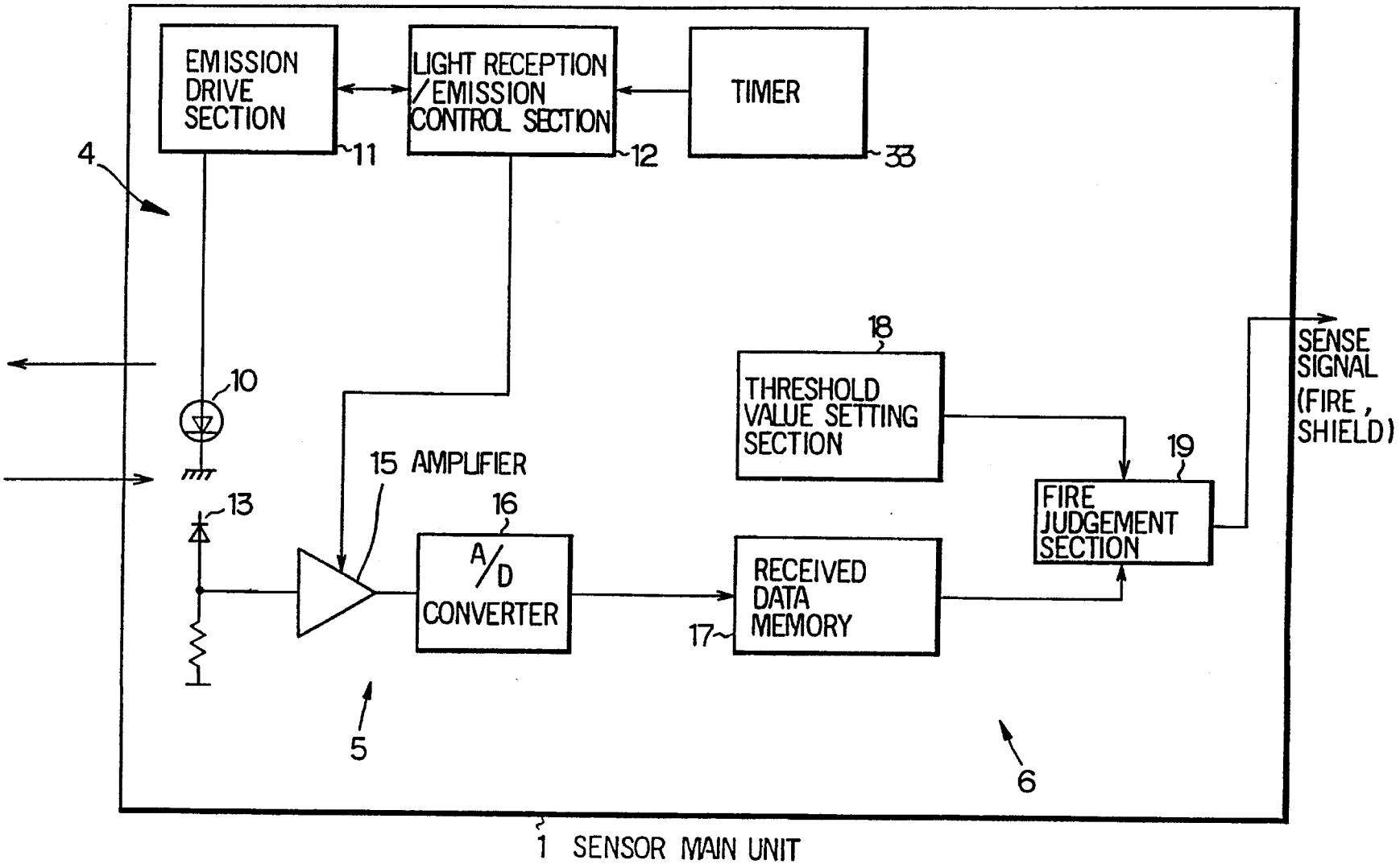
FIG. 21 is a block diagram of a main unit of the sensor shown in FIG. 20.

A tenth embodiment of the present invention will be described below. FIG. 20 is a perspective view of the overall construction of this embodiment. In this embodiment, a wavelength band converter capable of changing light in a particular wavelength band into light in a different particular wavelength band and outputting the converted light is used. That is, light in a particular wavelength band is returned from a reflecting unit 200, and an optical filter for transmitting only light in a particular wavelength band converted and and output from the wavelength converter. It is thereby possible to always receive only reflected light from the reflecting unit 200 while preventing reception of reflected light from a shielding object. The true quantity of received light from the reflecting unit 200 is obtained in this manner.

In this embodiment, as shown in FIG. 20, a sensor main unit 1 is provided with a light emitting device 10 capable of emitting light in a wavelength band (A) (first wavelength band) in the vicinity of a wavelength $\lambda_1$ and a light receiving device 13 with a filter 310 which transmits light in a wavelength band (B) (second wavelength band) in the vicinity of a wavelength $\lambda_2$ but does not transmits light in the wavelength band (A). On the other hand, the reflecting unit 200 is provided with a wavelength converting device 210 (wavelength converting means) for converting light in the wavelength band (A) into light in the wavelength band (B) and outputting the converted light.

The construction of the sensor main unit 1 in accordance with this embodiment also is generally the same as that of the other embodiments, but differs in that the light emitting device 10 emits light in the wavelength band (A) (first wavelength band) in the vicinity of a wavelength $\lambda_1$, and the wavelength converting device 200 and other components are provided while the control sections for light emission/reception controls are removed.

Figure 22:
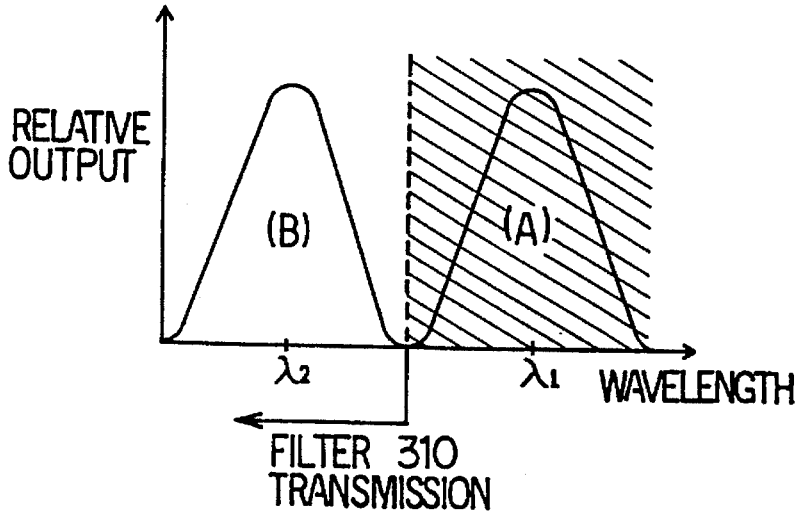
FIG. 22 is a diagram of filter characteristics and wavelength bands (A) and (B) in the sensor shown in FIG. 20.

In this embodiment, the filter 310 which transmits light in the wavelength band (B) at a transmissivity of approximately 100% but which does not transmits light in the wavelength band (A) is provided in front of a condenser lens 52. FIG. 22 shows the characteristics of the filter 310 with respect to the two wavelength bands (A) and (B).

On other other hand, the wavelength converting device 210 is provided in the reflecting unit 200.

The wavelength converting device 210 is made on the basis of utilization of a phenomenon wherein a chemical compound absorbs energy of introduced light and becomes excited to emit light with a transition. When light in the particular wavelength band (A) is introduced, the wavelength converting device 210 emits light in the wavelength band (B) different from the wavelength band (A). Devices of the kind, e.g., IR sensor card (commercial name) made by QUANTEX, capable of emitting visible light by receiving infrared rays is known. The wavelength converting device in accordance with the present invention may be selected from such devices.

Also, a condenser lens 53 for converging light from the light emitting device 10 to the wavelength converting device 210 is provided in the reflecting unit 200. The wavelength converting device 210 is disposed at a focal point of the condenser lens 53.

Light in the wavelength band (A) emitted from the light emitting device 10 is converted into light in the wavelength band (B) by the thus-constructed reflecting unit 200. The beam of light introduced into the reflecting unit 200 is turned by 180° and is received by a light receiving section 5 of the sensor main unit 1 after being changed into substantially parallel light by the condenser lens 52. Needless to say, any wavelength band (B) other than that shown in FIG. 22 may be used as long as it is different from the wavelength band (A).

Figure 23:
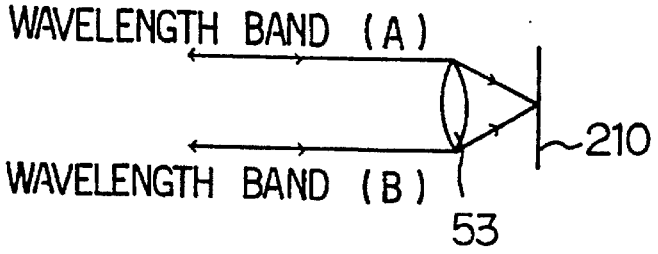
FIG. 23 is a diagram of the function of a wavelength converting device of the sensor shown in FIG. 20.
Figure 24:
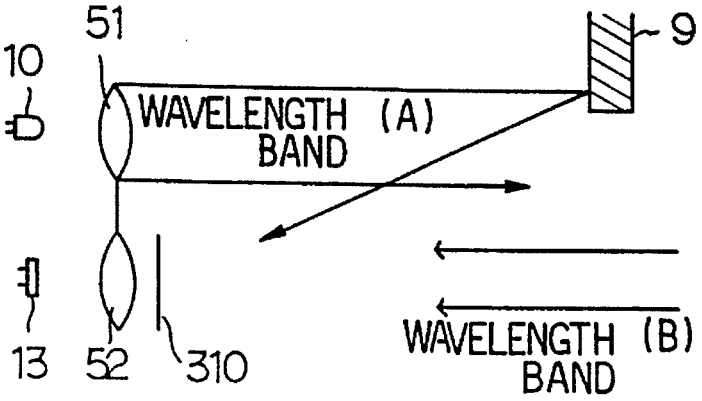
FIG. 24 is a diagram of a state of observation light in a case where a shielding object exists with the sensor shown in FIG. 20.

The operation of the thus-constructed separate type photoelectric smoke sensor in accordance with the tenth embodiment of the present invention will be described below with reference to FIGS. 23 and 24. FIG. 23 is a diagram of the operation of the wavelength converting device 210, and FIG. 24 is a diagram showing a state of observation light in a case where a shielding object exists.

In this embodiment, the light emitting device 10 always emits light in the wavelength band (A). This light is introduced into the reflecting unit 200, converted from the wavelength band (A) to the wavelength (B) and thereafter outputted, as described above. The light outputted from the reflecting unit 200 travels to the light receiving section 5 of the sensor main unit 1.

The filter 310 provided at the light receiving section 5 transmits light in the wavelength band (B). Accordingly, reflected light in the wavelength band (B) passes through the filter 310 to be received by the light receiving device 13. Thus, in an ordinary situation, light in the wavelength band (A) emitted from the light emitting device 10 is received by the light receiving device 13 after being converted into light in the wavelength band (B).

The operation in a situation where a shielding object 9 exists in the observed region will be explained.

In this case, light in the wavelength hand (A) emitted from the light emitting device 10 travels to the shielding object 9 and is reflected by this object. In accordance with the present invention, the influence of the reflected light is removed by utilizing the effect that the shielding object 9 reflects light in the wavelength band (A).

That is, in a case where the shielding object 9 exists, reflected light from the shielding object 9 is light in the wavelength band (A) emitted from the light emitting device 10. Accordingly, this light is cut by the filter 310 and is not received by the light receiving device 13. Therefore, even if the shielding object 9 exists in the observed region, light incident upon the light receiving device 13 is only light from the reflecting unit 200, and there is no influence of reflected light from the shielding object.

According to this embodiment, another light receiving device may be provided and a filter (not shown) for transmitting only light in the wavelength band (A) may be disposed in front of the light receiving device, thereby enabling a shielding object to be directly detected.

In this embodiment, a light emitting diode may be used as the light emitting device 10. However, a laser device may also be used according to the characteristics of the wavelength converting device. Further, the light emitting device 10 is not limited to a constant emission type and may be of an intermittent emission type.

Figure 25:
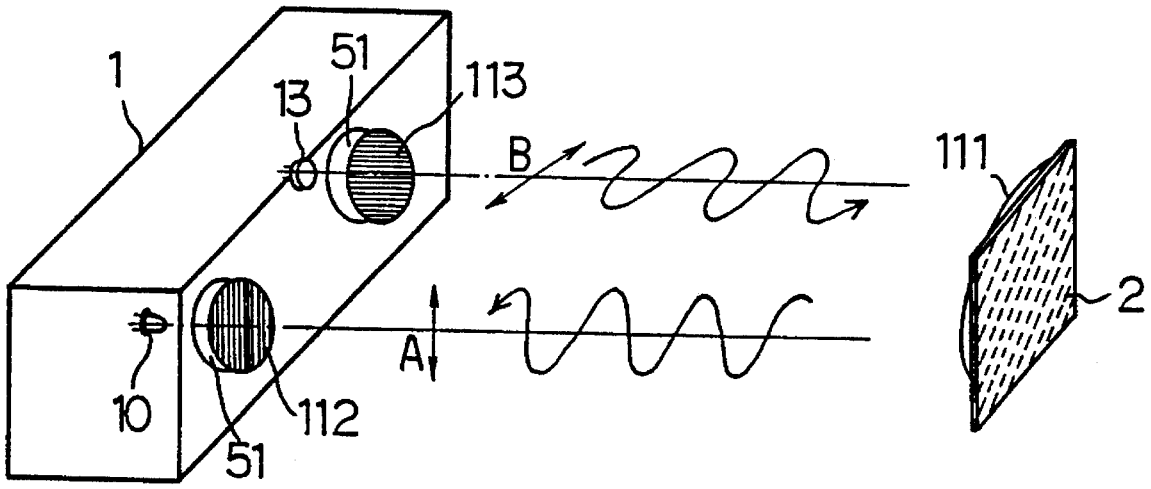
FIG. 25 is a is a perspective view of the overall construction of a separate type photoelectric smoke sensor in accordance with an eleventh embodiment of the present invention.
Figure 26A:
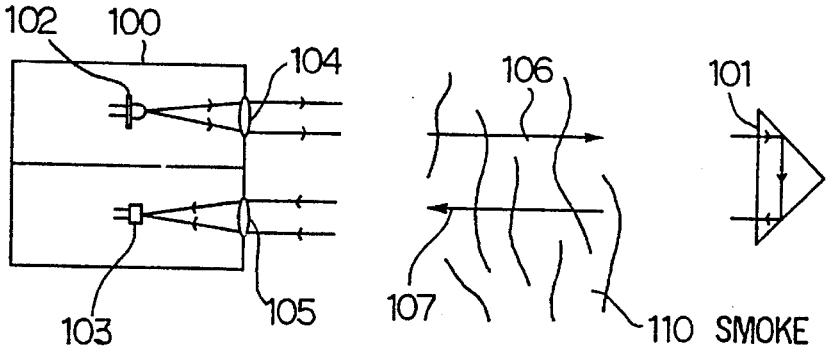
FIG.26(a) PRIOR ART
FIG. 26(*a*) and 26(*b*) are diagrams of a conventional separate type photoelectric smoke sensor.
Figure 26B:
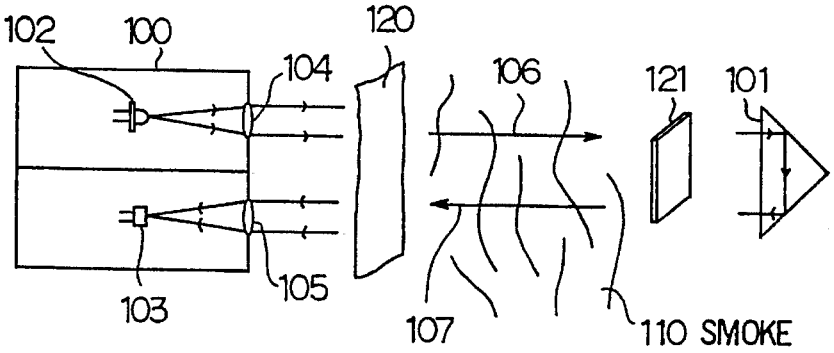
FIG.26(b) PRIOR ART

An eleventh embodiment of the present invention will be described below. FIG. 25 is a perspective view of the overall construction of this embodiment. In this embodiment, a wavelength plate for transmitting an incident beam by rotating a plane of polarization of the incident beam by a predetermined angle is used. That is, the arrangement is such that only light polarized in a particular direction is returned from a reflecting plate 2 and reflected light from a shielding object is not received. The true quantity of reflected light from the reflecting plate 2 is thereby obtained.

In this embodiment, as shown in FIG. 25, a sensor main unit 1 is provided with a light emitting device 10 and a light receiving device 13. The construction of the sensor main unit 1 is generally the same as the other embodiments and details thereof will not be described. A first polarization filter 112 is provided in front of the light emitting device 10, and a second polarization filter 113 having a plane of polarization differing by 90° from that of the first polarization filter 112 is disposed in front of the light receiving device 13. Further, a λ/4 wavelength plate 111 is disposed in front of the reflecting plate 2. The λ/4 wavelength plate is an optical element for rotating a plane of polarization of an emergent beam by 45° relative to an incident beam.

Light emitted from the light emitting device 10 is collimated by a collimator lens 51 and is polarized by the first polarization filter 112. The plane of polarization of this light is changed by 45° by the λ/4 wavelength plate 111. This light is then turned by 180° by the reflecting plate 2 formed of a retroreflection mirror to pass the λ/4 wavelength plate 111 again. Therefore, the light returned from the reflecting plate 2 has the plane of polarization shifted by 90° in comparison with the original state. However, this reflected light passes through the second polarization filter 113 to be received by the light receiving section 5, since the plane of polarization of the second polarization filter 113 disposed in front of the light receiving device 13 is different from that of the first polarization filter 112 by 90°.

On the other hand, light reflected by a shielding object 9 has the same polarizing direction as the light emitted from the light emitting device 10. Therefore, the reflected light from the shielding object cannot pass through the second polarization filter 113 and cannot reach the light receiving section 5. Consequently, only the reflected light from the reflecting plate 2 is received by the light receiving section 5, thereby making it possible to determine whether or not there is a fire without any influence of reflected light from the shielding object 9.

In this embodiment, λ/4 wavelength plate is used. However, a sensor may be arranged by using a λ/2 wavelength plate with which any conversion angle can be designated. In this case, there is a need to set the angle of the plane of polarization of each polarization filter according to the conversion angle of the λ/2 wavelength plate.

What is claimed is:

1. A separate type photoelectric smoke sensor which accommodates the presence of obstructive shielding objects, comprising;

light emitting means for emitting a light beam along a predetermined path; a reflecting plate arranged along said predetermined path and disposed at a certain distance from said light emitting means for reflecting said light beam;

light receiving means for receiving reflected light from said reflecting plate; and judgement means for outputting a sense signal if light received from said light receiving means is smaller than a predetermined threshold value, the quantity of reflected light from a shielding object interposed between said light emitting means and said reflecting plate is obtained from the difference between the quantity of received light measured during lighting of said light emitting means in a situation where there is no shielding object and the quantity of received light measured during lighting of said light emitting means in a situation where there is a shielding object, and the difference between the quantity of reflected light and the quantity of received light measured during lighting of said light emitting means is compared with said predetermined threshold value within said judgement to determine if there is a fire.

2. A separate type photoelectric smoke sensor which accommodates the presence of obstructive shielding objects, comprising;

light emitting means for emitting a light beam along a predetermined path; a reflecting plate arranged along said predetermined path and disposed at a certain distance from said light emitting means for reflecting said light beam;

light receiving means for receiving reflected light from said reflecting plate; and judgement means for outputting a sense signal if light received from said light receiving means is smaller than a predetermined threshold value, the quantity of reflected light from a shielding object interposed between said light emitting means and said reflecting plate is obtained from the ratio of the quantity of received light measured during lighting of said light emitting means in a situation where there is no shielding object and the quantity of received light measured during lighting of said light emitting means in a situation where there is a shielding object, and the difference between the quantity of reflected light and the quantity of received light measured during lighting of said light emitting means is compared with said predetermined threshold value within said judgement to determine if there is a fire.

3. A separate type photoelectric smoke sensor according to claim 1 or 2, wherein said light emitting means comprising:

a fire-observation light emitting section for emitting a light beam to a reflecting plate disposed at a certain distance from the fire-observation light emitting section;

a light receiving means comprising a light receiving section for receiving reflected light from the reflecting plate;

said judgement means comprising a judgment section for outputting a sense signal if a received light output from said light receiving section is smaller than said predetermined threshold value; and a shield-observation light emitting section provided in a position deviated from an optical axis connecting said fire-observation light emitting section, the reflecting plate and said light receiving section and at a predetermined distance from said fire-observation light emitting section;

wherein said fire-observation light emitting section and said shield-observation light emitting section are alternately lighted intermittently; the quantity of reflected light from a shielding object is obtained from the quantity of received light measured during lighting of said fire-observation light emitting section, the quantity of received light measured during lighting of said shield-observation light emitting section and the ratio of the quantity of received light measured during lighting of said fire-observation light emitting section in a situation where there is no shielding object and the quantity of received light measured during lighting of said shield-observation light emitting section in the same situation; and the difference between the quantity of reflected light thereby obtained and the quantity of received light measured during lighting of said fire-observation light emitting section is compared with the threshold value to determine whether or not there is a fire.

4. A separate type photoelectric smoke sensor according to claim 1 or 2, wherein said light emitting means comprising:

a light emitting section for emitting a light beam to a reflecting plate disposed at a certain distance from the light emitting section;

a light receiving means comprising a fire-observation light receiving section for receiving reflected light from the reflecting plate;

said judgement means comprising a judgment section for outputting a sense signal if a received light output from said fire-observation light receiving section is smaller than said predetermined threshold value; and a shield-observation light receiving section provided in a position deviated from an optical axis connecting said light emitting section, the reflecting plate and said fire-observation light receiving section and at a predetermined distance from said fire-observation light receiving section;

wherein said light emitting section is lighted intermittently; light emitted from said light emitting section is alternately received by said fire-observation light receiving section and said shield-observation light receiving section; the quantity of reflected light from a shielding object is obtained from the quantity of received light measured during light receiving with said fire-observation light receiving section, the quantity of received light measured during light-receiving with said shield-observation light receiving section and the ratio of the quantity of received light measured during light-receiving with said fire-observation light receiving section in a situation where there is no shielding object and the quantity of received light measured during light-receiving with said shield-observation light receiving section in the same situation; and the difference between the quantity of reflected light thereby obtained and the quantity of received light measured during light-receiving with said fire-observation light receiving section is compared with the threshold value to determine whether or not there is a fire.

5. A separate type photoelectric smoke sensor according to claim 1 or 2 wherein said light emitting means comprising:

a light emitting section for emitting a light beam to a reflecting plate disposed at a certain distance from the light emitting section;

a light receiving means comprising a light receiving section for receiving reflected light from the reflecting plate;

said judgement means comprising a judgement section for outputting a sense signal if a received light output from said light receiving section is smaller than said predetermined threshold value;

said light emitting section including a fire-observation light emitting section for emitting a light beam of a predetermined first wavelength, and a shield-observation light emitting section for emitting a light beam of a predetermined second wavelength to detect the existence of a shielding object in an observed region between the fire-observation light emitting section and said light receiving section; and a filter for transmitting only light of the first wavelength, said filter being disposed in front of the reflecting plate;

wherein the fire-observation light emitting section and the shield-observation light emitting section are alternately lighted intermittently; the quantity of received light measured during lighting of the fire-observation light emitting section and the quantity of received light measured during lighting of the shield-observation light emitting section are compared; and the difference between the quantities of received light and the threshold value are compared to determine whether or not there is a fire.

6. A separate type photoelectric smoke sensor according to claim 1 or 2, wherein said light emitting means comprising:

a light emitting section for emitting a light beam to a reflecting plate disposed at a certain distance from the light emitting section;

a light receiving means comprising a light receiving section for receiving reflected light from the reflecting plate;

said judgement means comprising a judgment section for outputting a sense signal if a received light output from said light receiving section is smaller than said predetermined threshold value;

said light receiving section including a fire-observation light receiving section having a filter for transmitting only a light beam of a predetermined first wavelength, and a shield-observation light receiving section having a filter for transmitting only a light beam of a predetermined second wavelength;

a filter for transmitting only light of the first wavelength, said filter being disposed in front of the reflecting plate; and said light emitting section comprising a light emitting section which emits light having both the first and second wavelengths;

wherein the quantities of light received by the fire-observation light receiving section and the shield-observation light receiving section are compared; and the difference between the quantities of received light and the threshold value are compared to determine whether or not there is a fire.

7. A separate type photoelectric smoke sensor according to claim 1 or 2, wherein said light emitting means comprising:

a fire-observation light emitting section for emitting a light beam to a reflecting plate disposed at a certain distance from the fire-observation light emitting section;

a light receiving means comprising a light receiving section for receiving reflected light from the reflecting plate;

said judgement means comprising a judgment section for outputting a sense signal if a received light output from said light receiving section is smaller than said predetermined threshold value;

a first polarization filter disposed in front of the reflecting plate;

a second polarization filter disposed in front of said fire-observation light emitting section and having the same plane of polarization as said first polarization filter;

a shield-observation light emitting section for detecting the existence of a shielding object in an observed region between said fire-observation light emitting section and said light receiving section; and a third polarization filter disposed in front of said shield-observation light emitting section and having a plane of polarization shifted by 90° from a plane of polarization of said first polarization filter;

wherein said fire-observation light emitting section and said shield-observation light emitting section are alternately lighted intermittently; the quantity of received light measured during lighting of said fire-observation light emitting section and the quantity of received light measured during lighting of said shield-observation light emitting section are compared; and the difference between the quantities of received light and the threshold value are compared to determine whether or not there is a fire.

8. A separate type photoelectric smoke sensor according to claim 1 or 2, wherein said light emitting means comprising:

a light emitting section for emitting a light beam to a reflecting plate disposed at a certain distance from the light emitting section;

a light receiving means comprising a fire-observation light receiving section for receiving reflected light from the reflecting plate;

said judgement means comprising a judgment section for outputting a sense signal if a received light output from said fire-observation light receiving section is smaller than said predetermined threshold value;

a first polarization filter disposed in front of the reflecting plate;

a second polarization filter disposed in front of said fire-observation light receiving section and having the same plane of polarization as said first polarization filter;

a shield-observation light receiving section for detecting the existence of a shielding object in an observed region between said light emitting section and said fire-observation light receiving section; and a third polarization filter disposed in front of said shield-observation light receiving section and having a plane of polarization shifted by 90° from a plane of polarization of said first polarization filter;

wherein said light emitting section is lighted intermittently; light emitted from said light emitting section is alternately received by said fire-observation light receiving section and said shield-observation light receiving section; the quantity of reflected light measured during light receiving with said fire-observation light receiving section and the quantity of received light measured during light-receiving with said shield-observation light receiving section are compared; and the difference between the quantities of reflected light and the threshold value are compared to determine whether or not there is a fire.

9. A separate type photoelectric smoke sensor according to claim 1 or 2, wherein said light emitting means comprising:

a light emitting section for emitting a light beam to a reflecting plate disposed at a certain distance from the light emitting section;

a light receiving means comprising a light receiving section for receiving reflected light from the reflecting plate;

said judgement means comprising a judgment section for outputting a sense signal if a received light output from said light receiving section is smaller than a threshold value;

a first polarization filter disposed in front of the reflecting plate; and a second polarization filter rotatably disposed in front of one of said light receiving section and said light emitting section;

wherein said light emitting section is lighted intermittently; said second polarization filter is rotated in synchronization with cycles of said lighting by 90° at one time so that the planes of polarization of said first and second polarization filters coincide with each other or are shifted from each other by 90°; the quantity of received light measured when the planes of polarization of said first and second polarization filters coincide with each other and the quantity of received light measured when the planes of polarization of said first and second polarization filters are shifted by 90° from each other are compared; and the difference between the quantities of received light and the threshold value are compared to determine whether or not there is a fire.

10. A separate type photoelectric smoke sensor according to claim 7, wherein said second polarization filter is rotated by a motor.

11. A separate type photoelectric smoke sensor according to claim 1 or 2, wherein said light emitting means comprising:

a light emitting section for emitting a light beam to a reflecting plate disposed at a certain distance from the light emitting section;

a light receiving means comprising a light receiving section for receiving reflected light from the reflecting plate;

said judgement means comprising a judgement section for outputting a sense signal if a received light output from said light receiving section is smaller than said predetermined threshold value; and shading means disposed in front of the reflecting plate to intercept, for a predetermined period of time, light which travels from said light emitting section to be incident upon the reflecting plate, said shading means having a low reflectivity;

wherein the quantity of received light measured during shading of the reflecting plate and the quantity of received light measured during exposure of the reflecting plate are compared, and the difference between the quantities of received light and the threshold value are compared to determine whether or not there is a fire.

12. A separate type photoelectric smoke sensor according to claim 11 wherein said shading means comprises a chopper having a low-reflectivity rotating blade, said rotating blade being rotated to mask a front surface of the reflecting plate for the predetermined period of time.

13. A separate type photoelectric smoke sensor according to claim 11 wherein said shading means comprises an electronic shutter changed between a transparent state and a shading state to mask a front surface of the reflecting plate for the predetermined period of time.

14. A separate type photoelectric smoke sensor according to claim 1 or 2, wherein said light emitting means comprising:

a light emitting section having emission means for emitting a light beam in a predetermined first wavelength band;

a reflecting section disposed on the same optical axis as said light emitting section at a certain distance from said light emitting section, said reflecting section having wavelength conversion means for converting the light beam in the first wavelength band into a light beam in a second wavelength band and outputting the converted light;

said light receiving means including a section for receiving reflected light from said reflecting section, said light receiving section having reception means for receiving reflected light from said reflecting section and a filter which transmits the light beam in the second wavelength band but which does not transmits the light beam in the first wavelength band; and a judgement means comprising a judgment section for outputting a sense signal if a received light output from said light receiving section is smaller than a threshold value previously set.

15. A separate type photoelectric smoke sensor according to claim 1 or 2, wherein said light emitting means comprising:

a light emitting section for emitting a light beam to a reflecting plate disposed at a certain distance from the light emitting section;

said light receiving means including a section for receiving reflected light from the reflecting plate;

said judgement means comprising a judgment section for outputting a sense signal if a received light output from said light receiving section is smaller than said predetermined threshold value;

a first polarization filter disposed in front of said light emitting section;

a $\lambda/2$ wavelength plate disposed in front of said reflecting plate to convert reflected light form said reflecting plate into a light beam having a phase different from a phase of the light beam passing through said first polarization filter; and a second polarization filter disposed in front of said light receiving portion, said second polarization filter being in phase with reflected light passing through said $\lambda/2$ wavelength plate.

16. A separate type photoelectric smoke sensor according to claim 1 or 2, wherein said light emitting means comprising:

a light emitting section for emitting a light beam to a reflecting plate disposed at a certain distance from the light emitting section;

said light receiving means including a section for receiving reflected light from the reflecting plate;

said judgement means comprising a judgment section for outputting a sense signal if a received light output from said light receiving section is smaller than said predetermined threshold value;

a first polarization filter disposed in front of said light emitting section;

a second polarization filter disposed in front of said light receiving portion, said second polarization filter having a plane of polarization shifted by 90° from a polarization plane of said first polarization filter; and a $\lambda/4$ wavelength plate disposed in front of said reflecting plate.

17. A separate type photoelectric smoke sensor according to claim 8, wherein said second polarization filter is rotated by a motor.

* * * * *